US005505188A

United States Patent [19]

Williams

[11] Patent Number: 5,505,188

[45] Date of Patent: Apr. 9, 1996

[54] PAINT BALL GUN

[76] Inventor: Robert A. Williams, 2721 White Settlement Rd., Fort Worth, Tex. 76107

[21] Appl. No.: 210,010

[22] Filed: Mar. 17, 1994

[51] Int. Cl.[6] ..... F41B 11/02; F41B 11/06

[52] U.S. Cl. ..... 124/74; 124/49; 124/76; 221/200

[58] Field of Search ..... 221/200; 414/288, 414/304; 124/45, 49, 50, 56, 70–76

[56] References Cited

U.S. PATENT DOCUMENTS

| | | | |
|---|---|---|---|
| 2,792,262 | 5/1957 | Hathorn | 414/304 X |
| 2,956,839 | 10/1960 | Hermans | 414/304 X |
| 3,788,298 | 1/1974 | Hale | 124/76 |
| 4,819,609 | 4/1989 | Tippmann | 124/72 |
| 4,850,330 | 7/1989 | Nagayoshi | 124/76 |
| 4,936,282 | 6/1990 | Dobbins et al. | 124/74 |
| 5,078,118 | 1/1992 | Perrone | 124/74 |
| 5,280,778 | 1/1994 | Kotsiopoulos | 124/73 |
| 5,282,454 | 2/1994 | Bell et al. | 124/49 |
| 5,339,791 | 8/1994 | Sullivan | 124/73 |

FOREIGN PATENT DOCUMENTS

| | | | |
|---|---|---|---|
| 872414 | 10/1981 | U.S.S.R. | 414/304 |

*Primary Examiner*—John A. Ricci
*Attorney, Agent, or Firm*—Arthur F. Zobal

[57] ABSTRACT

A bolt having an opening formed therethrough is slidably located in the bore of the gun. The bolt is held in a rear position by a sear with the bolt opening closed by a valve which extends into the bolt opening and engages a rear facing bolt seat. A passageway extends into the bolt opening by way of a valve for allowing pressurized gas to flow into the bolt opening. A trigger mechanism releases the bolt for allowing the bolt to be moved forward for allowing the valve and seat to separate for allowing the gas to flow through the bolt opening for forcing a ball from the rear end of the barrel out of the gun. Forward movement of the bolt is stopped by a lock member located in an aperture formed through the wall of the bolt which is forced outward into a slot of the gun body when the lock member reaches the slot. A cock valve located in a cock valve chamber releases gas from the cock valve chamber to force the lock member back into the bolt aperture and to force the bolt back to the rearward position. A ball inlet extends into the bore forward of the bolt when the bolt is in its rear position for allowing balls sequentially to pass into the bore. The bolt return gas is allowed to pass into a feed tube coupled to the ball inlet for forcing the next ball into the ball inlet.

53 Claims, 13 Drawing Sheets

609
627

28
621
623
613B
603
613A
627
621
623
621A
609
625
611

627
613B 30
607
605
631
603
634
29

481

26
623
605
631
607
609
633

611
623

PAINT BALL GUN

BACKGROUND OF THE INVENTION

1. Field of the Invention

The invention relates to a pneumatic gun for shooting balls such as balls filled with liquid paint for sporting events.

2. Description of the Prior Art

U.S. Pat. Nos. 4,819,609; 4,936,282; 5,097,816; 5,161,516; 5,166,457; and 5,228,427 disclosed different types of pneumatic ball guns and ball feed mechanisms.

SUMMARY OF THE INVENTION

It is an object of inventions to provide a new and useful pneumatic ball gun which has a number of advantages over the prior pneumatic ball guns.

The gun comprises a body having an elongated chamber with a front end and rear end, a gun barrel supported by the body and having an aperture extending from the front end of the chamber to a forward open end such that the chamber and aperture form a continuous bore. A ball inlet extends into the bore near the front end of the chamber for allowing a ball to enter the bore for movement in the bore forward of the inlet and out of the forward open end of the barrel. A bolt is located in the chamber for movement between rear cocked and forward positions. The bolt has a central opening with a gas outlet at the front end of the bolt. A valve is provided for closing the gas outlet of the bolt when the bolt is in its rear position in the chamber. A flow path is provided for allowing pressurized gas to flow into the rear portion of the chamber and into the central opening of the bolt. A sear is provided for holding the bolt in its rear cocked position. A trigger mechanism is provided for releasing the sear for allowing the gas in the rear portion of said chamber to move the valve forward for moving the bolt forward for allowing the gas to flow through the gas outlet of the bolt for forcing a ball in the bore out of the forward open end of the gun barrel.

In a further aspect, a slot is formed in the body which extends outward from the front end of the chamber rearward of the ball inlet. At least one lock member aperture is formed through the sidewall structure of the bolt and which leads to the central opening of the bolt. A lock member located in the aperture is movable outward into the slot by the gas in the central opening of the bolt for stopping forward movement of the bolt. The lock member is moveable inward of the lock member aperture to allow the bolt to move in the chamber. The lock member also stops rearward movement of the bolt.

In a further aspect, a cock valve chamber is provided with a cock valve located in the cock valve chamber for movement between forward and rearward positions. A rod is located next to the rear end of the cock valve and extends out of the rear end of the cock valve chamber. A channel is coupled to the cock valve chamber for the passage of pressurized gas into the cock valve chamber. The cock valve is normally held in its rearward position. A connecting channel extends from the rearward portion of the cock valve chamber to the front end of the elongated chamber by way of the lock member slot. A seal surrounding the cock valve normally seals the cock valve chamber from the connecting chamber. The trigger mechanism when moved to its release position, is moved by the bolt to engage the rod and moves the rod and hence the cock valve forward for releasing gas from the cock valve chamber by way of the connecting channel for moving the lock member inward and for flow into the elongated chamber for moving the bolt to its rear position in the elongated chamber for allowing the trigger mechanism and sear to hold the bolt in its cocked position.

In the embodiment disclosed the bolt has a seat in its central opening for engagement with the valve for closing the bolt outlet and a flow path extends into the central opening of the bolt by way of an opening formed through the shaft of the bolt. In addition, means is provided for limiting forward movement of the valve.

In a further aspect a feeder tube is connected to the ball inlet. Bolt return gas is flowed into the feeder tube to enhance movement of the next ball into the inlet.

A ball holding chamber is coupled to the feeder tube. Gas from the gun is directed to an inflatable mechanism in the ball holding chamber for preventing balls from blocking the outlet of the ball holding chamber into the feeder tube.

Means also is provided for mixing oil with the gas in the elongated chamber for lubricating the balls.

In addition, a pressure regulator is provided for regulating the gas pressure applied to the various channels and chambers of the gun.

DESCRIPTION OF THE PREFERRED EMBODIMENTS

Figure 1:
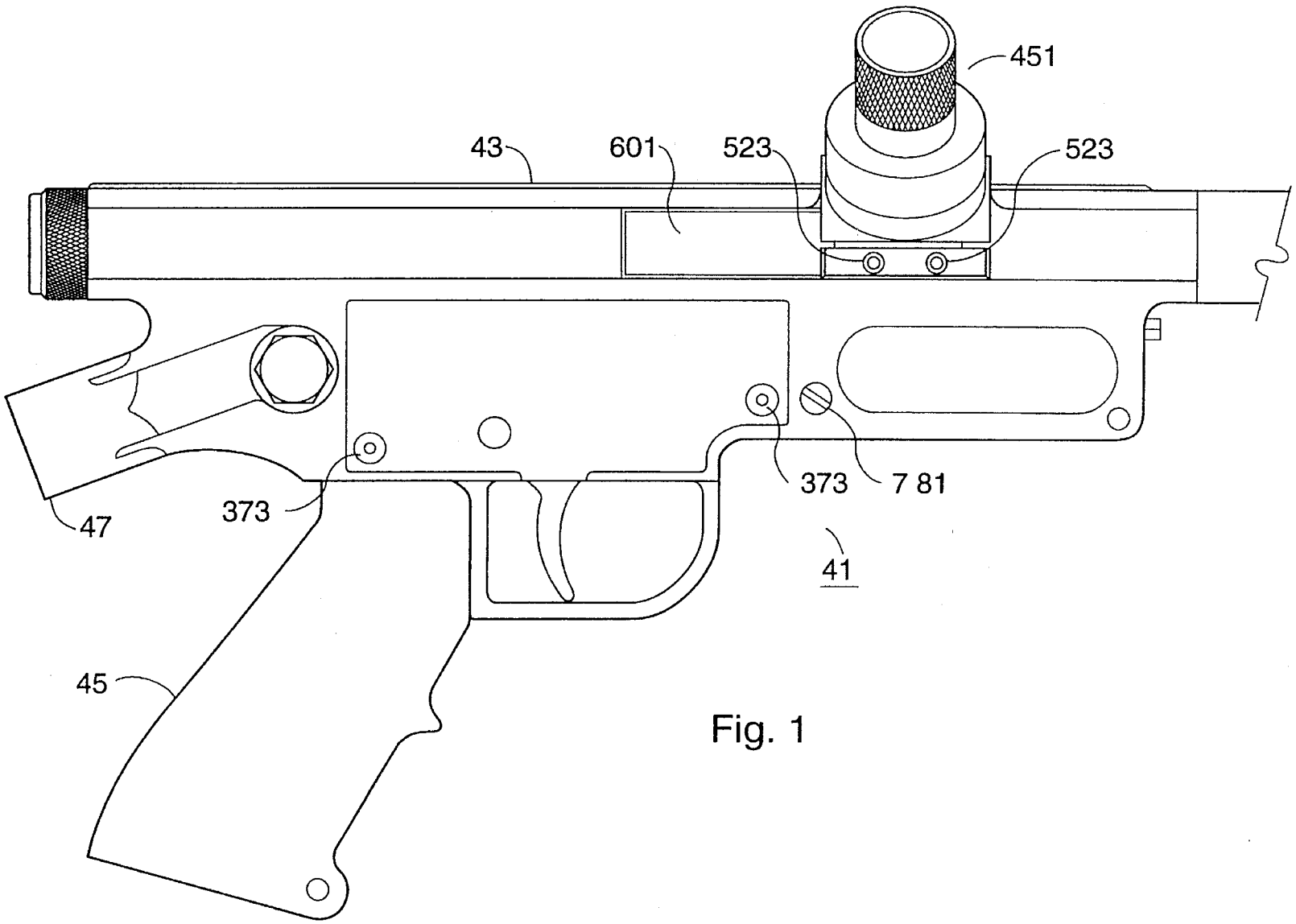
FIG. 1 is a right side view of the gun of the invention.
Figure 2:
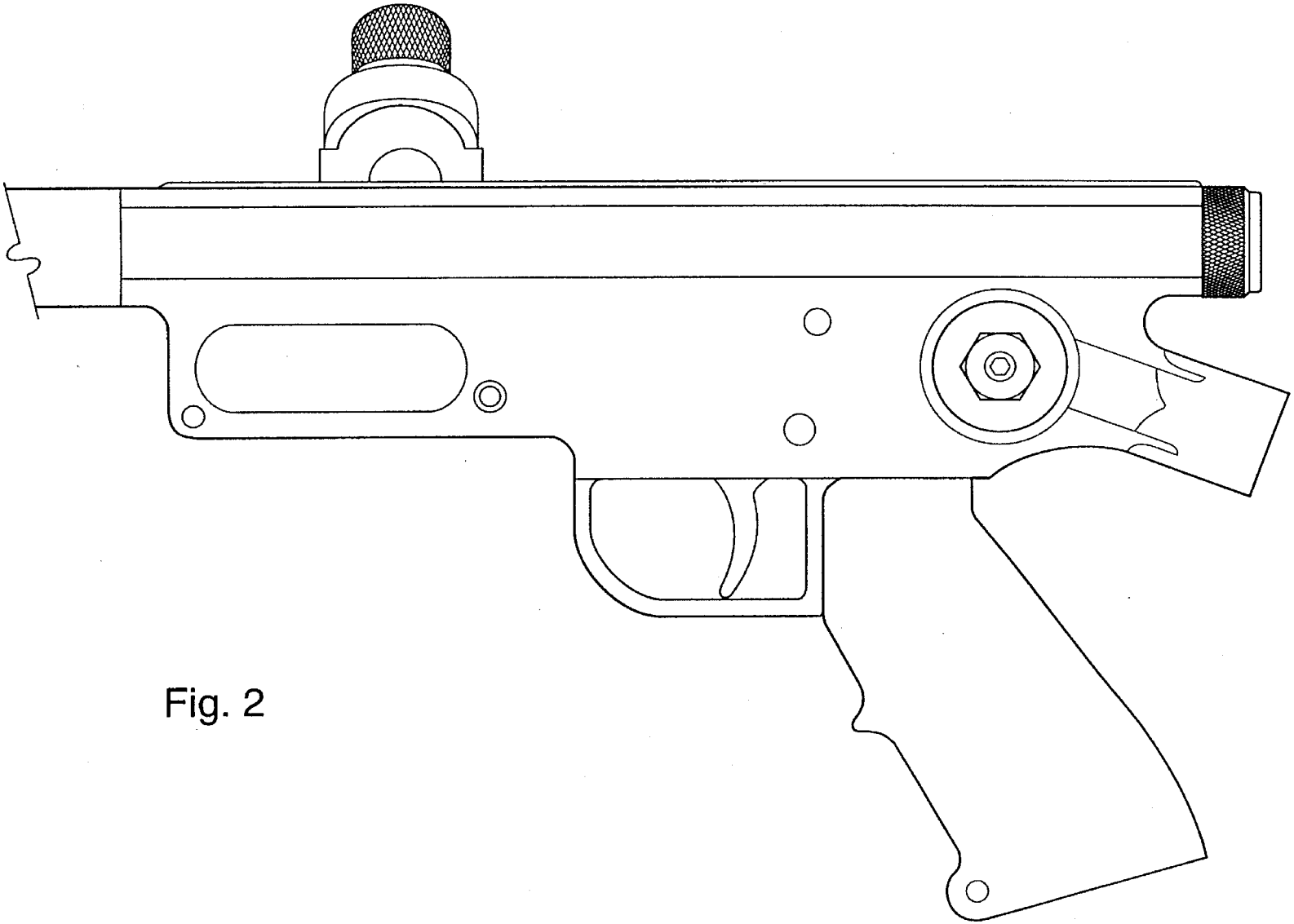
FIG. 2 is a left side view of the gun of the invention.

Referring now to FIGS. 1–5 of the drawings, the gun of the invention is identified by reference numeral 41. It comprises a metal body 43 having a handle or hand grip 45; an inlet 47 to which a bottle 49 of pressurized gas such as CO2 is coupled; an elongated chamber 51 which a slidable valve 121 and a slidable bolt 141 are located, a ball inlet 57 for receiving a ball 59, a feeder tube 451 coupled to the ball inlet; a barrel 61 with an aperture 63 coupled to the front end of the body such that the elongated chamber 51 and aperture 63 form a continuous bore, a sear 339, a trigger mechanism 309, and cock valve chamber 381 in which a cock valve 421 is slidably located.

The chamber 51 has a rear open end 65 with inner threads 67, an inner cylindrical wall 69, a larger diameter inner cylindrical slot 71, a forward inner cylindrical wall 73 of lesser diameter than wall 69, and a larger diameter inner cylindrical wall 75 with an open end 77 and inner threads 78. A small cylindrical slot 79 has a sealing O-ring 80 located therein.

The barrel 61 has outer threads 61T at its rear end which is located in the end 77 of the chamber 51 and screwed to the threads 78.

Figure 8:
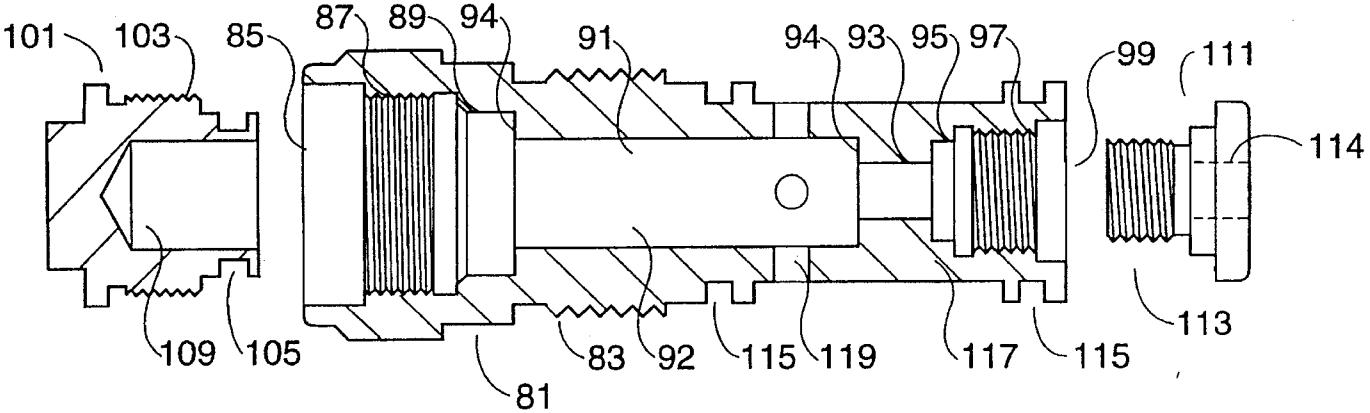
FIG. 8 is an exploded cross-sectional view of the valve plug and components thereof.

Referring also to FIG. 8, a valve plug 81 having outer threads 83 is inserted into the rear end 65 of the chamber 51 and removably screwed to the threads 67. The valve plug 81 has an opening formed therethrough comprising a rear open cylindrical end 85 with inner threads 87; a smaller cylindrical portion 89 which leads to a smaller cylindrical portion 91 which leads to a still smaller cylindrical portion 93 having a rearward facing shoulder 94. Wall 93 leads to a cylindrical slot 95 in which a sealing O-ring 96 is located which in turn leads to a larger diameter portion with threads 97 and an open end 99. A rear end plug 101 having threads 103 and an annular slot 105 with an O-ring 107 is screwed to the threads 87. The rear end plug 101 has a cylindrical opening 109 formed therein with the same diameter as opening 91. A front end O-ring plug 111 having threads 113 is screwed to the threads 97. The O-ring plug 111 has a cylindrical opening 114 with the same diameter as opening 93. Annular slots 115 are formed in the outer wall of the valve plug 81 for receiving O-rings 116. A smaller diameter outer wall 117 is formed between the slots 115 defining an annulus 118 with apertures 119 formed through the wall 117 communicating the annulus 118 with the opening 92 within the cylindrical wall 91.

A valve tube 121 is slidably located in the openings 93 and 114 and within the valve plug 81.

Figure 6:
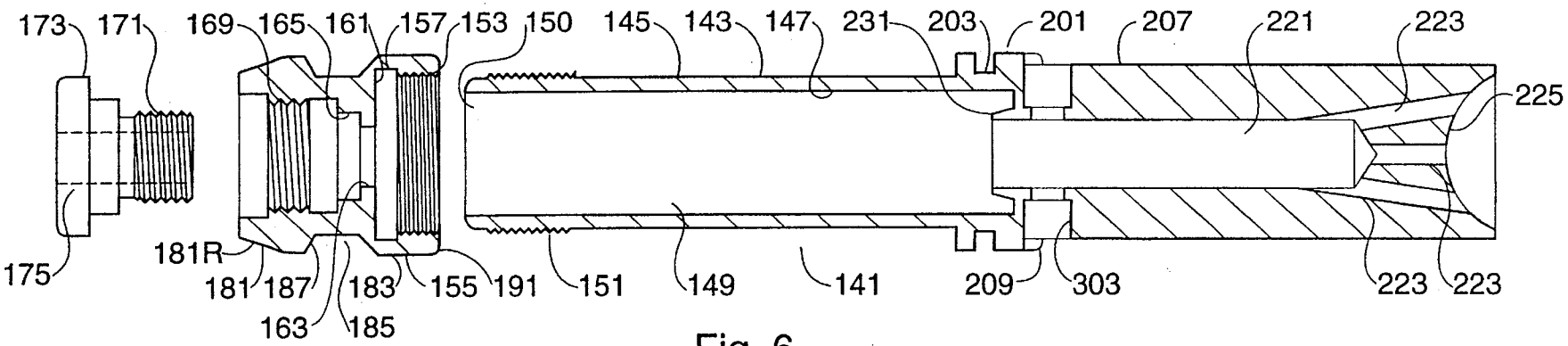
FIG. 6 is an exploded cross-sectional view of the bolt of the gun.
Figure 10:
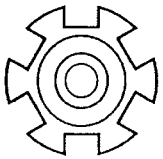
FIG. 10 is a rear end view of the cap of FIG. 9.
Figure 9:
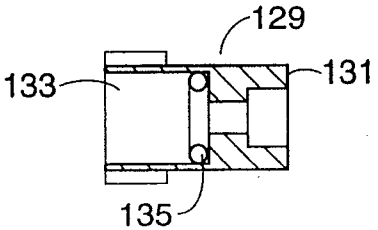
FIG. 9 is a cross-sectional view of the front cap of the valve which extends into the bolt.
Figure 7:
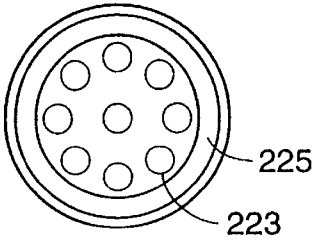
FIG. 7 is a front end view of the bolt of the gun.

Referring also to FIG. 6, the bolt 141 comprises a cylindrical member 143 having an outer cylindrical wall 145 and an inner cylindrical wall 147 forming a rear cylindrical open portion 149 leading to a rear open end 150. The outer wall 145 has threads 151 which are screwed into the threads 153 of a rear bolt cap 155. The bolt cap 155 has an annular slot 157 for holding an O-ring 159; a forward facing shoulder 161, a small cylindrical opening 163 for slidably receiving the valve tube 121, an annular slot 165 for receiving an O-ring 167 and inner threads 169 into which the threads 171 of an O-ring plug 173 are screwed. The O-ring plug 173 has a cylindrical opening 175 for slidably receiving the valve tube 121.

The bolt cap 155 has outer cylindrical wall portions 181 and 183 for slidingly engaging the chamber wall 52. An outer annular slot 185 is formed between wall portions 181 and 183 with a canted forward facing wall 187 for engaging the end 345 of the sear 339. The bolt member 155 also has a forward facing outer annular wall 191.

The cylindrical member 143 leads to a forward outer cylindrical wall 201 for slidingly engaging the chamber wall 52. An annular slot 203 is formed in wall 201 for receiving an O-ring 205. The outer wall 201 leads to a smaller diameter outer wall 207 with a forward facing shoulder 209 formed therebetween. The wall 207 forms an annulus 211 when located in chamber wall 52 and is slidingly received in chamber wall 73.

A cylindrical outlet opening 221 is formed in the front portion of the bolt 141 which is in fluid communication with opening 149 and which has smaller diameter outlet openings 223 leading to the forward end of opening 221. One of the openings 223 is at the axis of the bolt and the other openings 223 fan out to the front end 225 of the bolt 143.

Between openings 149 and 221 a rearward facing annular seat 231 is formed.

Figure 4:
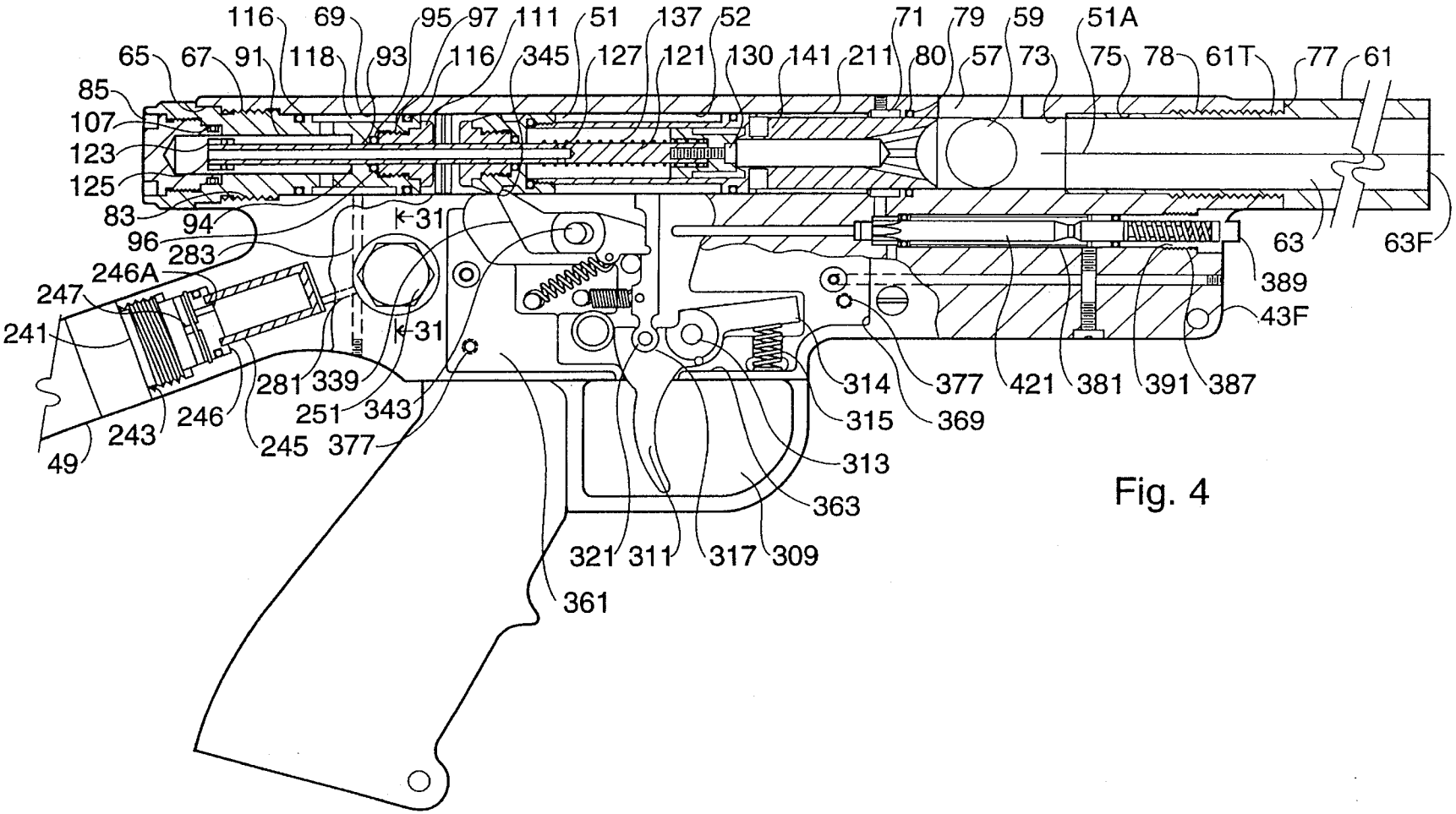
FIG. 4 is a partial cross-sectional view of the right side of the gun with the bolt in a rearward cocked position.

The valve tube 121 has a rear stop member 123 secured around the rear end of the valve tube 121. A bore 125 is formed into the valve tube 121 from its rear end forward with radial outlet openings 127 formed into the valve tube 121 such that they communicate with the bore 125 and are located in the bolt opening 149 at all positions of the bolt and valve. The forward portion of the valve is solid. A forward cap 129 is attached to the forward end of the valve tube 121 by way of a bolt 130. The cap has an annular forward facing surface 131 for engaging the bolt seat 231 when the bolt is in its cocked position as shown in FIG. 4. The cap 129 has a rear opening 133 surrounding the forward portion of the valve tube 121 and an O-ring 135. A coiled spring 137 surrounds the valve tube 121. Its forward end engages the O-ring 135. The rear end of the spring 137 engages the shoulder 161 of the bolt cap 155 and urges the valve tube forward relative to the bolt.

The gas inlet 47 has an opening 241 formed therein with threads 243 to which the threaded outlet end of a source 49 of gas under pressure is screwed. A filter 245 is located in the opening 241. The filter 245 is connected to an adapter 246 which has three apertures 246(A) formed therethrough and a pin 247. When the source 49 is screwed into the threads 243, the pin 247 opens the valve on the bottle 49 and allows gas to flow into the channel 281 by way of the openings 246A and the filter 245.

Figure 31:
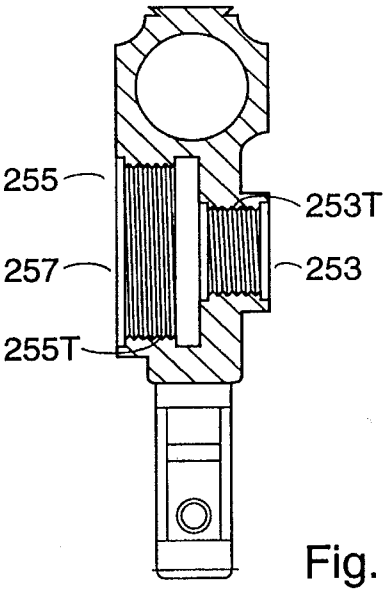
FIG. 31 is a cross-section of FIG. 4 taken along lines 31—31 thereof and with the regulator valve removed.

A pressure regulator 251 having a high pressure side 253 and a low pressure side 255 is located in an opening 257 (See FIGS. 31 and 32) formed through the gun body.

An inlet channel 281 is formed in the gun body from the opening 241 to the side of the opening 257 in which the high pressure side of the regulator 251 is located such that the channel 281 leads to the high pressure side 253 of the gas regulator 251. An outlet channel 283 is formed in the gun body from the opening 257 in which the lower pressure side 255 of the regulator 251 is located through the wall 52 of the chamber 51. Thus the channel 283 extends from the low pressure side of the regulator 251 to the annulus 118 formed between the valve plug wall 117 and the chamber wall 51.

Gas from the source 49 passes through channel 281 to the high pressure side 253 of the regulator, to the low pressure side 255, from the low pressure side through the channel 283, into the annulus 118, through the apertures 119 of the bolt to the opening 92, into the valve bore 125, through the apertures 127 and into the bolt opening 149 forcing the surface 131 of the valve cap 129 against the seat 231 when the bolt is in its cocked position.

Figure 5:
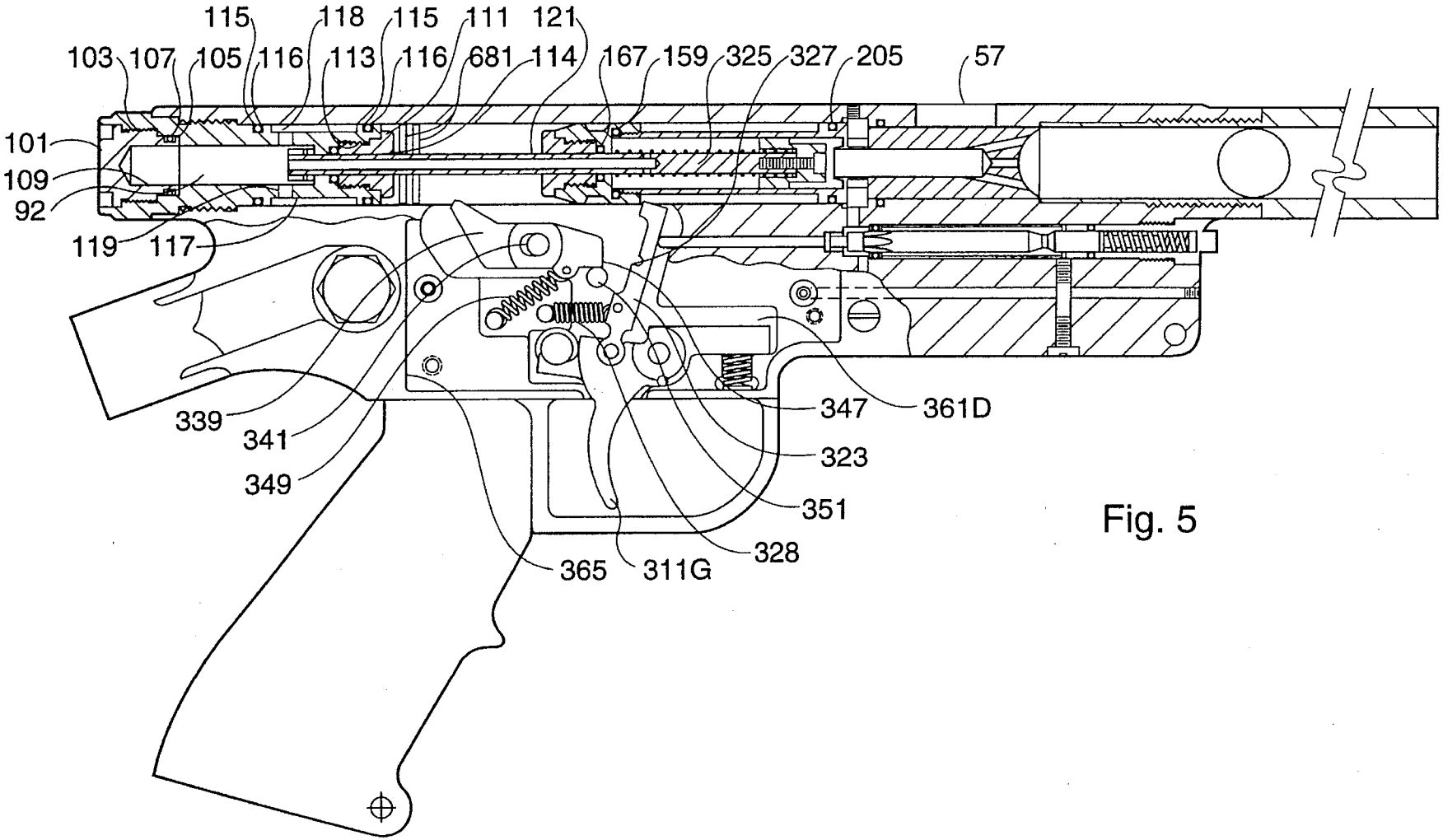
FIG. 5 is a partial cross-sectional view of the right side of the gun with the bolt in forward released position.

The bolt is held in this position by the sear 339. When the end 345 of the sear 339 is released from the wall 187 of the bolt, the pressurized gas in the valve plug 81 forces the valve tube 121 forward which in turn forces the bolt forward to a position as shown in FIG. 5. The valve tube 121 moves forward until it is stopped by the rear stop member 123 engaging the surface 94 of the valve plug 81 allowing the valve cap surface 131 to separate from the seat 231 as the bolt continues to move forward. This allows the pressurized gas in the bolt opening 149 to flow through the bolt opening 221 and through openings 223 for forcing a ball 59 in the bore 63 out of the front open end 63F of the barrel.

Forward and rearward movement of the bolt 141 is stopped by resilient lock members 301 slidably located in radial extending apertures 303 formed into bolt wall 207. The lock members 301 slide with the bolt until they reach the annular slot 71. At this position, the pressurized gas in the opening 221 forces the lock members 301 out into the slot 71 stopping forward movement of the bolt. In one embodiment there are six apertures 303 formed through the bolt wall with six lock members 301 located therein respectively.

The trigger mechanism 309 comprises a trigger member 311 pivotally coupled to the body by pin 313. The forward end of the trigger 311 has a bar 314 with a spring 315 engaging the underside of the bar and bottom wall 363 of a deeper cavity 361D formed in cavity 361 for normally urging the trigger member counter-clockwise as shown in FIG. 4. A partially round slot 317 is formed in the rear end of the trigger member for pivotally receiving a round end 321 of a trip member 323 also located in the cavity 361D. The trip member 323 has an upper end 325 and an engaging surface 327. A spring 328 is coupled to the trip member 323 and to the gun body for normally urging the trip member counter-clockwise as shown in FIG. 4.

The sear 339 has an elongated slot 341 in which a pin 343 connected to the gun body is located to allow the sear 339 to pivot about the pin 343. The sear also is located in the cavity 361D. It has an end 345 for engaging the surface 187 of the bolt member 155 for holding the bolt in a cocked position. The sear 339 has an opposite end 347 for engaging the surface 327 of the trip member 323. A spring 349 is coupled to the sear 339 and to the gun body for normally urging the sear 339 in a clockwise direction as shown in FIG. 4. A stop 351 limits clockwise movement of the sear 339. Members 311, 323 and 339 are located in the deeper cavity 361D.

When the trigger member finger grip 311G is moved clockwise as shown in FIG. 4, the trip member 323 is moved upward which pivots the sear 339 counter-clockwise as shown in FIG. 4, releasing the sear end 345 from the bolt surface 187 to allow the gas in the valve plug 81 to move the tube valve 121 forward which moves the bolt forward to fire the gun.

The cavity 361 is formed by a bottom wall 363, a rear wall 365, and a front wall 369. The top of the cavity 361D is open to the chamber 51. A removable plate 371 covers the cavity. The plate is held in place by screws 373 extending through apertures 375 formed through the plate 371 and screwed into threaded apertures 377 formed in the gun body. Removal of the plate 371 allows easy access to the sear and trigger mechanism for repair or replacement purposes.

The cock valve chamber 381 comprises a cylindrical opening formed in the forward end 43F of the body rearward. Threads 387 are formed in the chamber 381 at its forward end in which a cap 389 having threads 391 is inserted and screwed to the threads 387. The chamber 381 has a smaller diameter rear end 393 with an O-ring 395 located between two washers 397W one of which engages a shoulder 397 formed between walls 381 and 393. The chamber portion 393 has an aperture 399 leading to the annular slot 71. A smaller front diameter aperture 401 leads to a rod aperture 403 which opens into the cavity 361D.

A connecting channel extends through the gun body from the low pressure side 255 of the regulator 251 to a channel 413 which is in fluid communication with a threaded aperture 415 which leads to the chamber 381.

Figure 11B:
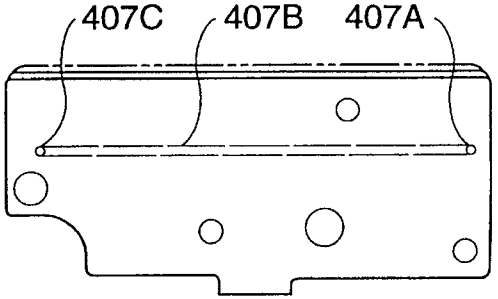
FIG. 11B is a plan view of the inside of the trigger mechanism cover plate.
Figure 11A:
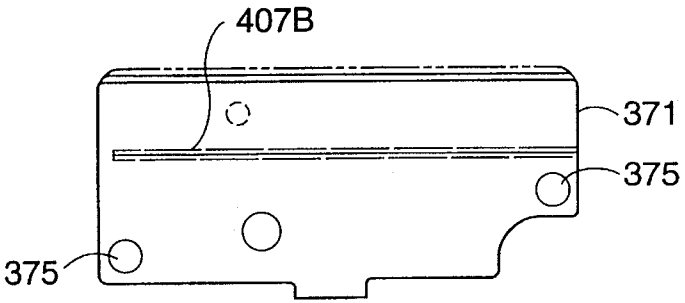
FIG. 11A is a plan view of the outside of the trigger mechanism cover plate.
Figure 32:
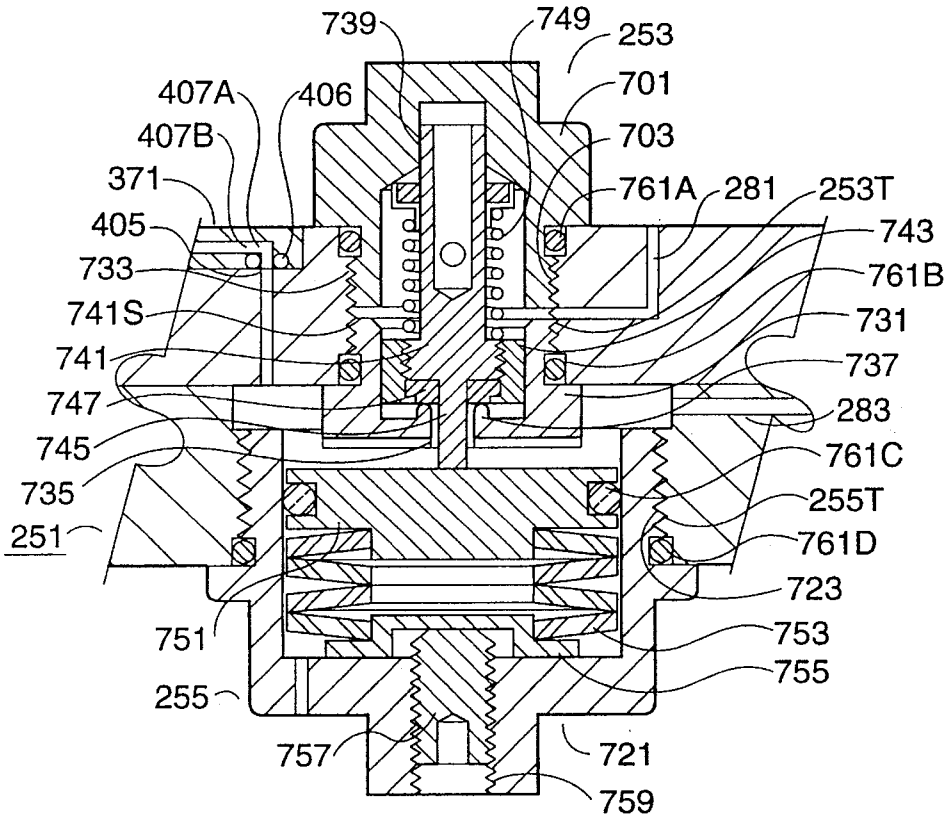
FIG. 32 is a cross-section of the gas regulator valve.

Referring to FIGS. 11A, 11B, and 32, the connecting channel comprises an aperture 405 formed through the wall of the gun body, O-ring 406 surrounding aperture 405; an inlet 407A, channel 407B, an outlet 407C formed in the trigger plate 371 and O-ring 410 surrounding the inlet to the channel 413. The front end of the channel 413 is plugged by a threaded member 417. An integral seal screw 419 is screwed into the aperture 415. Gas from the low pressure side of the regulator passes into the chamber 381 by way of the connecting channel 413 and aperture 415. The flow of the gas through aperture 415 is controlled by adjustment of a set screw 419S which is separate from screw 419. Adjustment of set screw 419S is carried out before screw 419 is screwed into the aperture.

The cock valve 421 is a solid cylindrical member having a rear end 423 with slots 425 at its rear end. A rod 427 having a larger diameter portion 429 is slidably located in aperture, 401, 403 with the end of rod portion 429 abutting against the end 423 of the valve 421 and with its rear end extending into the cavity 361D. Member 431 is an O-ring.

An annular slot 441 is formed in the valve 421. The front of the cock valve has a smaller diameter portion 443 around which a coiled spring 445 is located. The spring engages the plug 389 and shoulder 447 and urges the cock valve 421 rearward such that the slot 441 is rearward of the aperture 415 and the slots 425 are rearward of the O-ring 395. Member 449 is an O-ring. In the cock valve chamber 381, member 451T is a tube for holding the front washer 397W in place and for holding a wave spring washer 452W against a spacer 453S.

When the finger grip 311G of the trigger member is pulled backward to release the sear end 345 from the bolt surface 187 to allow the gas in the valve plug 81 to move the valve plug 121 forward which moves the bolt forward, the surface 191 of the bolt engages the top of the trip member 323 as shown in FIG. 5 and moves it forward causing the trip member to engage the rear end of the rod 427 and move it and the valve 421 forward to locate the slots 425 forward of the O-ring 395 and the annular slot 441 forward of the aperture 415. This allows gas in the chamber 381 to flow to engage the forward side of the annular slot 441 and momentarily hold the valve in the forward position and allows gas in the chamber 381 to flow under the O-ring 395 by way of the slots 425 into the aperture 399 and into the annular slot 71 forcing the lock members 301 inward in the apertures 303 and by way of the annular slot 71 forcing the bolt 141 rearward to its cocked position. The rearward surface 181R of the bolt member 155 forces the end 345 of the sear 339 downward allowing it to fit into the slot 185 and hold the bolt 141 in its cock position. When the trigger grip is released, the trigger member and trip member are rotated backward. The trip member is stopped by pin 351 with its surface 327 under the sear end 347 ready for another shot.

As the gas flows into the cock valve chamber 381, upon movement of the cock valve 421 forward, the pressure acts against the surface 441R to hold the valve 421 in its forward position momentarily. When the pressure in the chamber 381, 393, 399 and 71 equalizes, the spring 445 will push the valve 421 and its slots 425 rearward of the O-ring 395 to terminate flow of gas through aperture 399. As the valve 421 is pushed rearward by the spring 445, it pushes the rod 427 rearward ready for the next shot.

The lock out members 301 stop forward and rearward movement of the bolt and until they are pushed back into their apertures 303 which in effect allows the bolt to be held in a stationary position momentarily. This allows the ball to be forced completely out or nearly out of the barrel before the bolt starts returning to its cocked position. This allows the gun to shoot a ball further than if this timing feature was not employed. This timing feature simulates a pump gun with a closed bolt and allows a pressure of 435 psi to push a ball to 300 fps.

Referring now to FIGS. 1, 3, 12, 14–30, there will be described the feeder tube 451 and air passage block 601 for feeding balls to the inlet 57. The inlet 57 is formed on the top right and right side of the gun such that it extends into the chamber 51 at an angle of 45° relative to the central axis 51A of the chamber 51. The feeder tube 451 has a cylindrical wall 453, 455 extending from a block 457 with a cylindrical opening 459 extending therethrough from an inlet or top end 459(I) to an outlet or lower end 459(O). The wall 453 is thicker than wall 455. Threads 461 are formed between walls 453 and 455. A shoulder 463 formed on block 457 surrounds the base of cylindrical wall 453. Wall 465 is partially cylindrical.

The block 457 has a flat surface 471 at an angle of 45° relative to shoulder 463 which cuts into wall 465, a surface 473, 90° relative to surface 471, a surface 475 90° relative to surface 473 and a surface 477, 90° relative to surface 475. Thus surfaces 471 and 475 are parallel and surfaces 473 and 477 are parallel. A slot 481 having walls 481A, 481B, and 481C is formed in surface 475 from the outer wall to the opening 459. An aperture 491 is formed through annular wall 465 from walls 481A and 481B of slot 481 which extends through shoulder 463. The inlet of the aperture is identified at 491(I) and its outlet is identified at 491(O). A plurality of apertures 493 extend through wall 453 at an angle of 55° relative to the axis 459A of aperture 459 such that their axes 493A intersect the axis 459 below the shoulder 463 and near the outlet 459(O).

A cap 501 comprising a cylindrical wall 503 with threads 505 and an inward extending top wall 507 with a circular opening 509 is located around the wall 455 with its threads 505 screwed to threads 461 with its bottom edge 503B engaging shoulder 463 to form an annulus 511 around the wall 453 and the apertures 493. The aperture 491 extends through the shoulder 463 such that gas injected through aperture 491 within the slot 481 flows into the annulus 511, through the apertures 493 toward the outlet opening 459(O).

Figure 17:
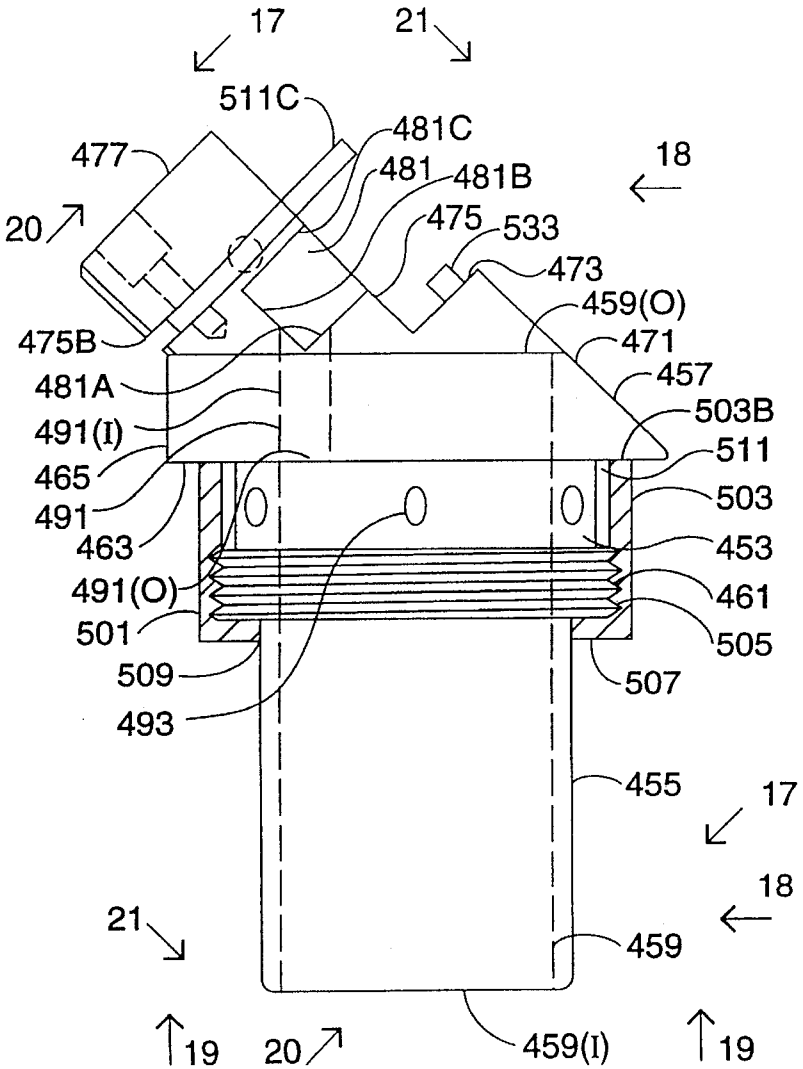
FIG. 17 is a side view of the feeder tube.
Figure 22:
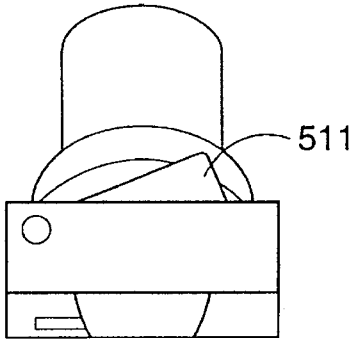
FIG. 22 is a view similar to that of FIG. 21 with the ball stop in the out of the way position.
Figure 24:
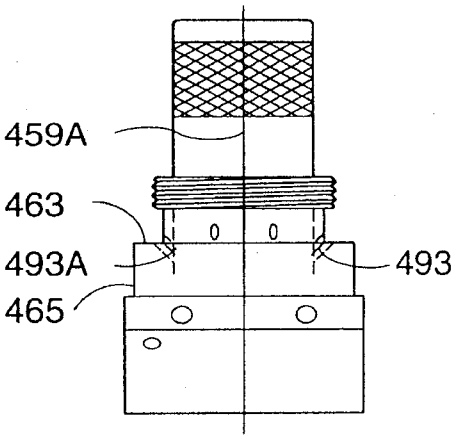
FIG. 24 is a side view of the feeder tube.
Figure 21:
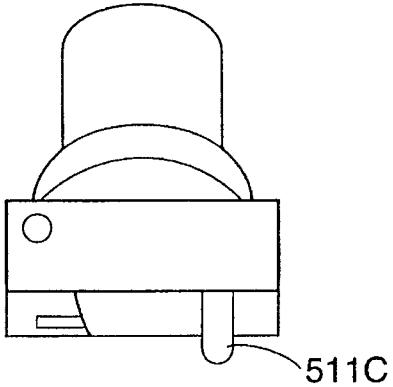
FIG. 21 is a view of the feeder tube as seen from lines 21—21 of FIG. 17.
Figure 23:
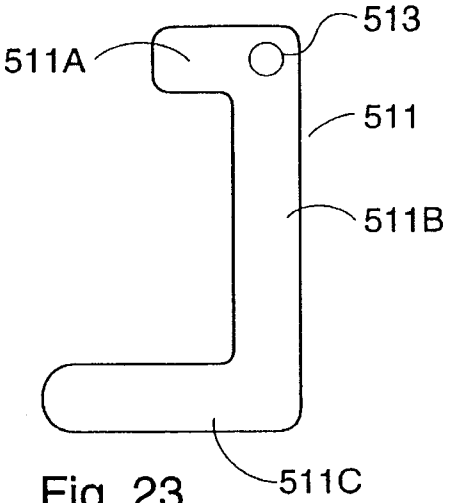
FIG. 23 is a side view of the ball stop.
Figure 19:
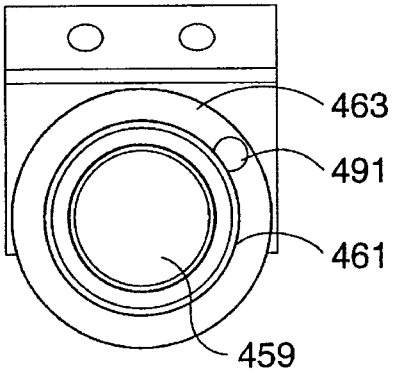
FIG. 19 is a view of the feeder tube as seen from lines 19—19 of FIG. 17.
Figure 20:
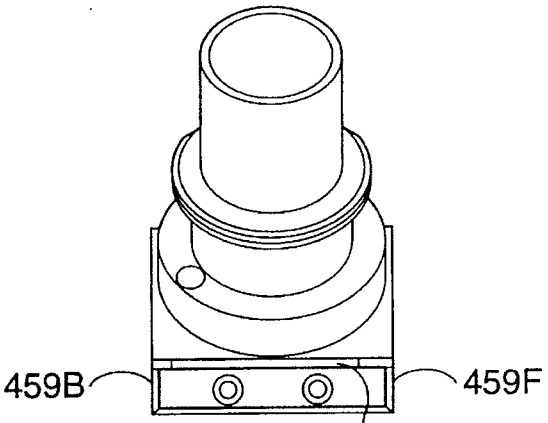
FIG. 20 is a view of the feeder tube as seen from lines 20—20 of FIG. 17.
Figures 25A, 25B, 26, 27, 28, 29, 30:
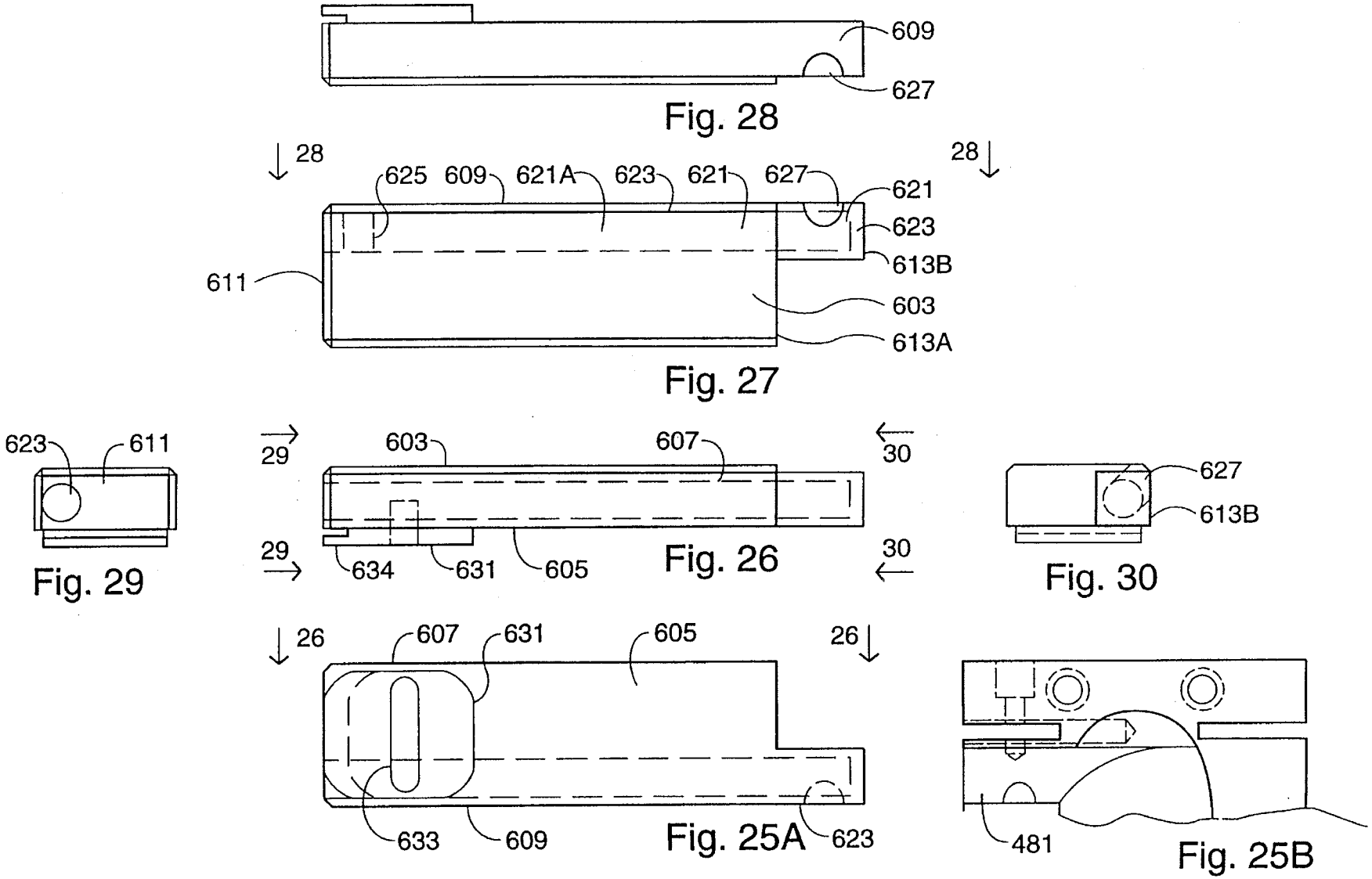
FIG. 25A is an inner side view of the air passage block.
FIG. 25B is a partial view of the feeder tube block similar to that to FIG. 18 illustrating the attachment of the air passage block to the feeder tube block.
FIG. 26 is a view of FIG. 25A as seen from lines 26— 26 thereof.
FIG. 27 is an outer side view of the air passage block.
FIG. 28 is a view of the air passage block of FIG. 27 as seen from lines 28—28 thereof.
FIG. 29 is an end view of the air passage block of FIG. 26 as seen from lines 29—29 thereof.
FIG. 30 is an end view of the air passage block of FIG. 26 as seen from lines 30—30 thereof.

The block portion 457 has slots 475A, 475B and 475C in which member 511 having arm portions 511A, 511B, and 511C is located with arm 511A located in slot 475A, arm 511B located in slot 475B, and arm 511C located in slot 475C and extending beyond surface 475 as shown in FIG. 17. The juncture of arms 511A and 511B has an aperture 513 extending therethrough for receiving a screw 515 allowing the member 511 to pivot about the screw 515. A coiled spring 517 is secured to the inside of arm 511A and to the wall 475AW to normally urge the arm 511C out and perpendicular to wall 475 as shown in FIG. 17.

Figure 3:
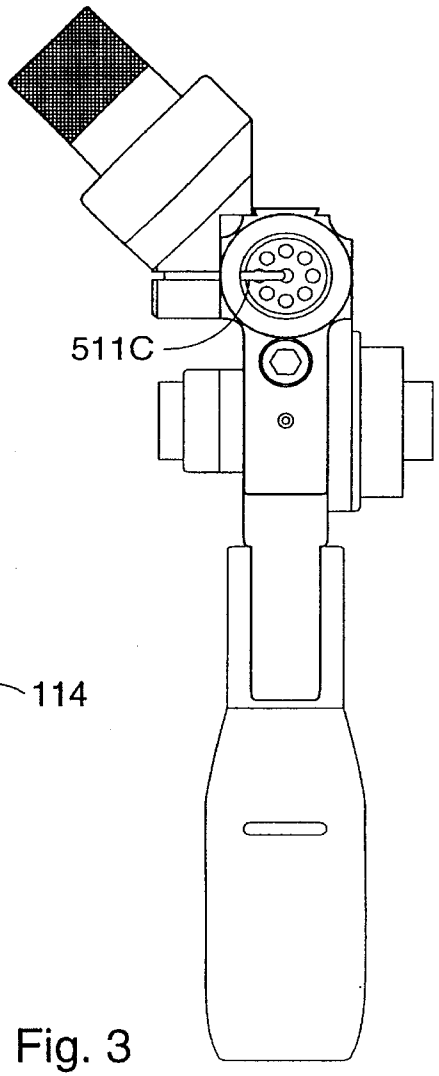
FIG. 3 is a front view of the gun of the invention.
Figure 13:
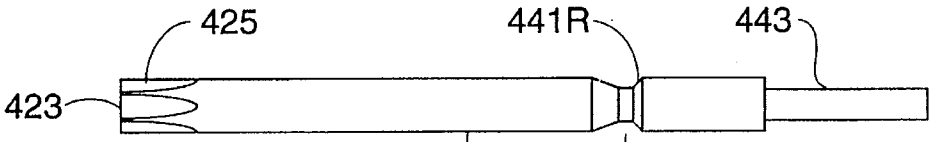
FIG. 13 is a side view of the cock valve.

Two apertures 521 are formed through block portion 475 for allowing two bolts 523 to attach the feeder tube to the body of the gun by way of two threaded apertures 531. When attached, the flat surface 475 of the block will engage the flat right side of the body of the gun and tab 533 of the block 457 will fit in slot 535 formed in the top side of the gun next to inlet 57. A slot 537 is formed through the wall of the gun next to the inlet 57 which extends to the chamber 51 for receiving the arm 511C of member 511 which arm will extend into the chamber 51 as shown in FIG. 3 and act to hold a ball in the chamber when the gun is not being fired. The arm 511C can pivot in the slot 475C out of the chamber 51 in the manner shown in FIGS. 21 and 22. The side 459F of the feeder tube blocks is located in front of the side 459B such that the ball when pushed by the bolt will move the arm 511C out of the chamber 51. The bolt will continue to move forward separating the valve cap 131 from the seat 231 allowing the pressurized gas to force the ball out of the bore. In this position the bolt will hold the arm 511C out of the chamber. The bolt then is returned to its rearward position allowing the arm 511C to return into the chamber 51.

An air block 601 is provided for channeling bolt return air from the chamber 51 to the inlet 491(I) of the feeder tube 451. Referring to FIGS. 1, 12, 14, 15, and 23–30, the air block 601 has an outer side 603, an inner side 605, a bottom side 607, a top side 609, a rear end 611, and a front end 613A, 613B. An aperture 621 extends from the rear end to near the end of a front extension 623. The aperture 621 is plugged by a screw 625 at the rear end. An opening 627 is formed through the wall of the extension 623 from sides 609 and 603 at an angle of 45° relative to the axis 621A of the aperture 621. The opening leads to the aperture 621. An extension 631 extends from the inner side 605 of the block near its rear end. The extension has a slot 633 formed therein which communicates with the aperture 621. The extension 631 has a rear extending tab 634.

The extension 623 fits in the slot 481 of the block 457 such that the opening 627 of the extension communicates with the opening 491 of the block 457.

Figure 14:
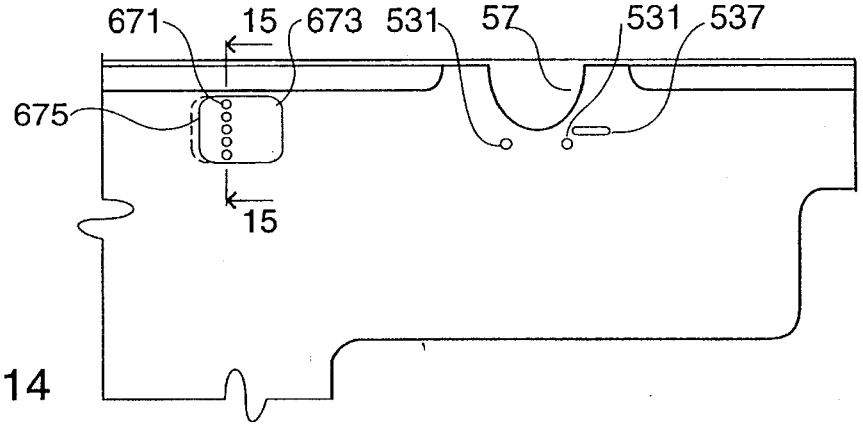
FIG. 14 is a right side view of a portion of the gun with the air passage block and feeder tuber removed.
Figure 16:
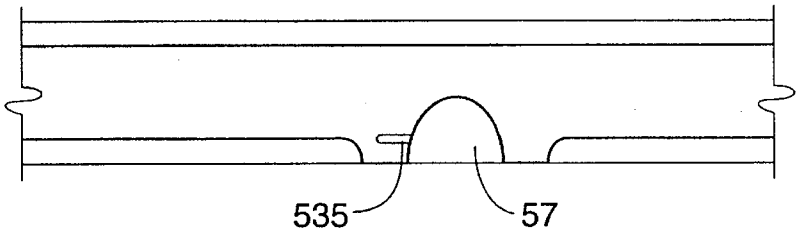
FIG. 16 is a view of the top of a portion of the gun with the air passage block and feeder tube removed.
Figure 15:
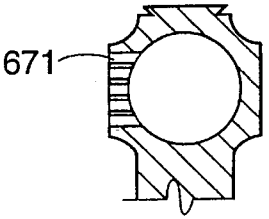
FIG. 15 is a cross-sectional view of FIG. 14 taken along lines 15—15 thereof.
Figure 12:
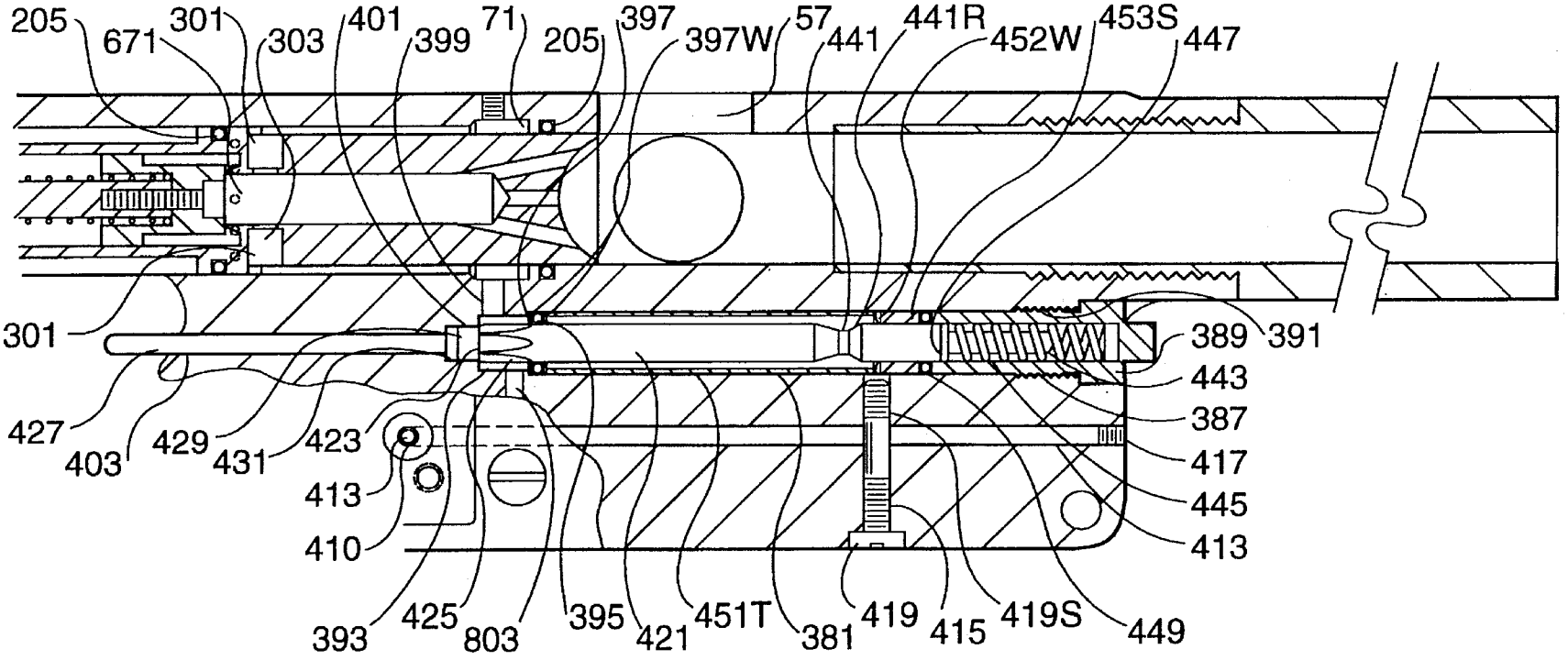
FIG. 12 is an enlarged view of the cock valve chamber and cock valve in the position of FIG. 4.
Figure 18:
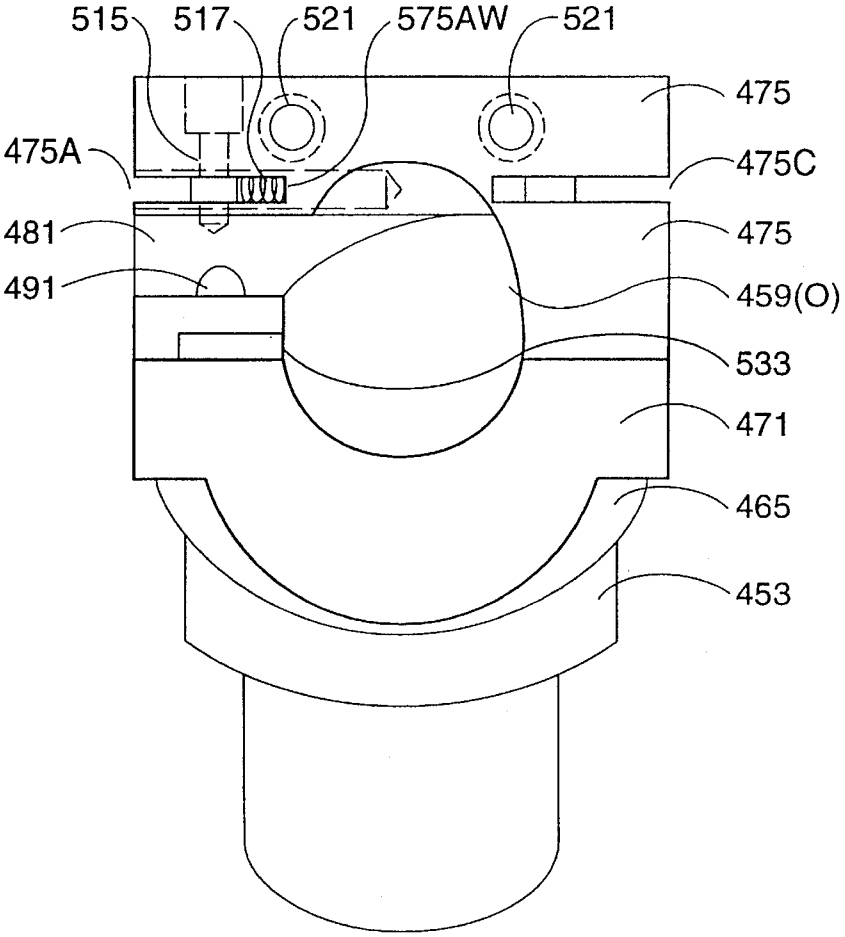
FIG. 18 is a view of the feeder tube of FIG. 17 as seen from lines 18—18 thereof.

Formed through the wall of the gun and communicating with the chamber 51 between the slot 71 and the O-ring 205 of the bolt when it is in its rear cocked position, are five apertures 671 as shown in FIGS. 12, 14, and 15. These five apertures lead to a slot 673 formed in the right outside of the gun for receiving the projection 631 of the block. The slot 673 has a lip 675 for receiving the tab 634 of the block 601. Thus when the feeder tube and block are secured to the gun, and with the air passage block extension 623 in the slot 481 of the feeder tube block 457 and with the tab 633 under the lip 675 of the slot 673, the air passage block is secured to the outside of the gun, with the slot 633 in communication with the apertures 671. Thus gas passage is provided from the chamber 51, through the apertures 671, through the slot 633, aperture 621, and outlet opening 627 of the block 601 to the opening 491(I), aperture 491, outlet 491(O), into the chamber 511 and through the apertures 493 of the feeder tube directing the gas toward the inlet 57 to facilitate movement of the balls from the feeder tube 451 into the chamber 51. The bolt return gas from the valve chamber 381 is applied to this gas passage when the bolt is returning to its cocked position when the O-ring 205 passes rearward of the apertures 671. The gas in chamber 51 flows between the inner wall of the chamber 51 and the outer wall 201 of the bolt ahead of the O-ring 205. Upon return of the bolt to the cocked position, there also is some over travel of the bolt in that the front end of the bolt surface 201 moves rearward of the apertures 671.

Also provided are fibrous washers 681 located around the valve tube 121 between the front O-ring plug 111 of the valve plug 81 and the rear O-ring plug 173 of the bolt 141 such that the bolt 141 engages the front washer 681 each time the bolt is moved to its cocked position. The washers 681 are filled with a light oil which is squeezed into the chamber 51 and eventually mixes with the bolt return gas which is injected into the feeder tube through apertures 493. The oily gas is applied to the balls in the feeder tube to facilitate their movement through the inlet 57 into the chamber 51 for firing.

Referring now to FIG. 32, the regulator valve 351 comprises a high pressure side cover 701 having threads 703 which are screwed into the threads 253T of the opening 257 and a low pressure side cover 721 having threads 723 screwed into the threads 255T of the opening 257. A brass inner fitting 731 having threads 733 is screwed into the threads 253T. The fitting has a small aperture 735 with a surrounding seat 737. A pin 739 has an enlarged portion 741 is screwed to an annular fitting 743 which is slidably located in the fitting 731. The pin 739 has a small diameter rod 745 with a annular member 747 located around the rod 745 and adapted to engage the seat 737. A spring 749 is located around the pin 739 and has an end effectively engaging the cover 701 and a shoulder 741S of portion 741 urging the rod 745 through the opening 735.

On the low pressure side there is slidably located a disc member 751 which is urged toward the rod pin 745 by spring like washers 753 one of which also engages a movable seat 755. A set screw 757 screwed into threads 759.

If the high pressure gas used is $CO_2$ its pressure on the high side of the regulator may vary to 450 psi at 26° F. to 1800 psi at 100° F. Thus the pressure of $CO_2$ varies with the temperature. The pressure on the low side preferably is regulated to 435 psi by screwing the set screw 757 in until the desired pressure of 435 psi is achieved. Screwing the set screw 757 in allows the gas to flow into the low side between the member 747 and the seat 737. Members 761A, 761B, 761C, and 761D are O-rings.

Thus the use of the regulator allows a constant pressure to be obtained using pressurized $CO_2$ even though the ambient temperature may vary.

Figure 33:
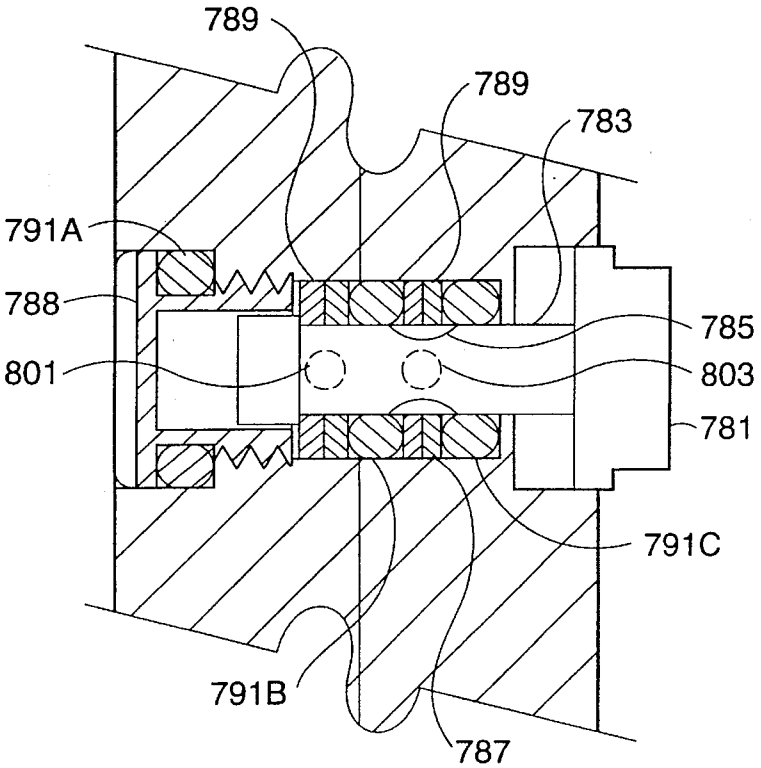
FIG. 33 is a cross-section of a bolt return button.

Referring to FIG. 33, there is disclosed a bolt return button 781 which is used to return the bolt in the event that the cock valve chamber and valve fail to operate properly. The button 781 has a shaft 783 with slots 785, located in one end of an aperture 787 formed through the body of the gun. A cap 788 is screwed into the other end of the aperture 787. Members 789 are lock washers and members 791A, 791B, and 791C are O-rings.

An aperture 801 extends from the chamber 413 to aperture 787 and an aperture 803 extends from aperture 787 to the cock valve chamber portion 393. When the button 781 is pushed to the left as seen in FIG. 33, the slots 785 provide a passage from the left side of aperture 787 as shown in FIG. 33, pass the O-ring 791B and to the right side thereby allowing pressurized gas from chamber 413 to flow to chamber portion 393 through aperture 399 for moving the bolt to its cocked position.

Figure 35:
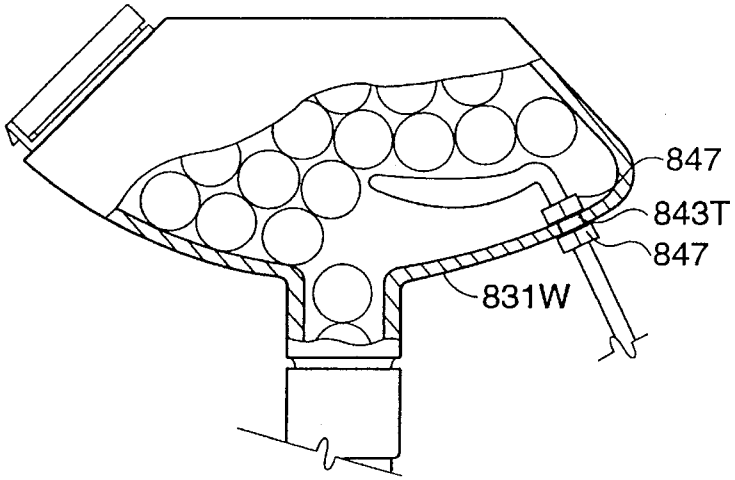
FIG. 35 illustrates the pneumatic tongue agitator in an inflated condition.
Figure 34:
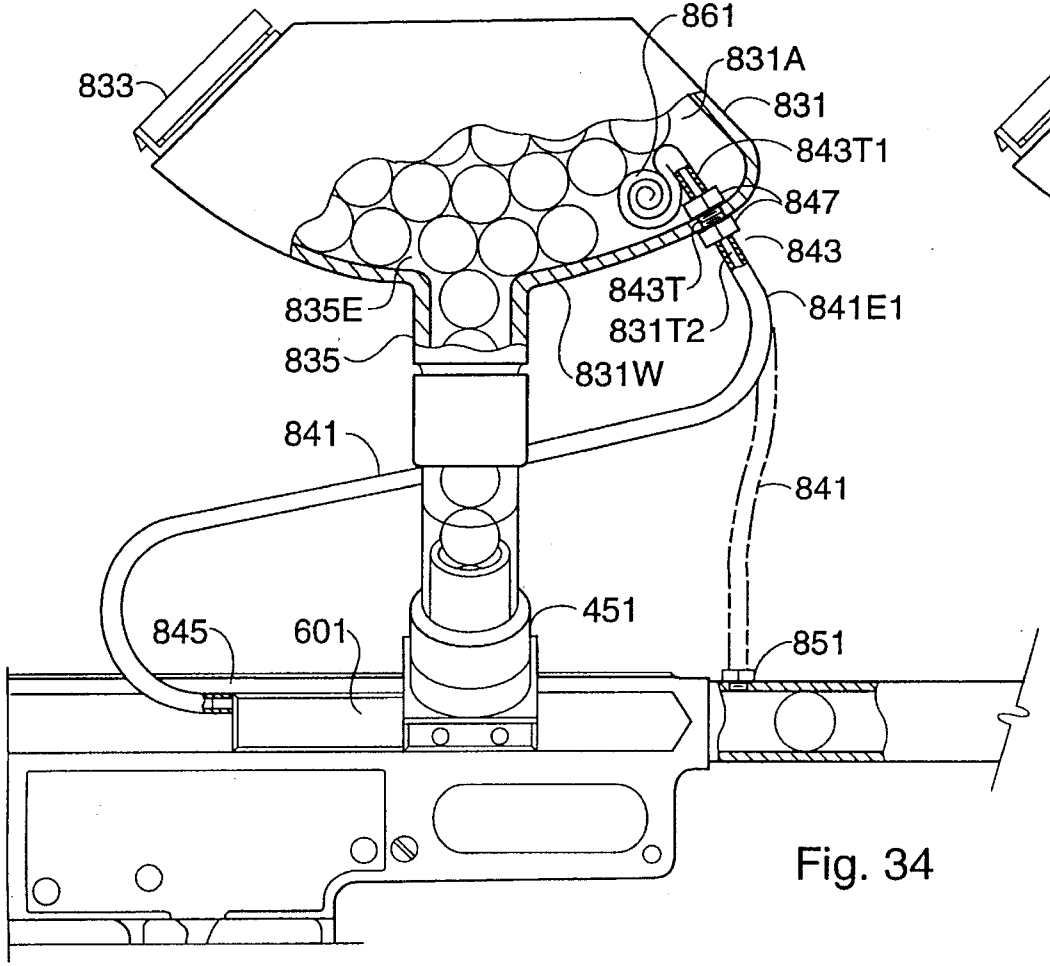
FIG. 34 illustrates a ball holding chamber coupled to the feeder tube with a pneumatic tongue agitator in a deflated condition.

Referring now to the FIGS. 34 and 35, there is disclosed a ball chamber or loader 831 for receiving paintballs 59 by way of a lid 833 and for serially or sequentially feeding the paintballs to the gun by way of the feeder tube 451. The chamber 831 has a neck 835 coupled to the feeder tube 451. A gas conduit 841 is provided having end 843 coupled to the chamber 831 and an end 845 coupled to the aperture 621 of the air passage block 601. In this embodiment the screw 625 of the block 601 is removed. In the embodiment disclosed, the end 843 comprises tubular fitting 843T that extends through the chamber wall 831W and which is held in place by nuts 847. Inner and outer tubular members 843T1 and 843T2 extend from the inner and outer ends of member 843T with the member 843T1 being located in the interior 831A of the chamber 831. The conduit 841 is a flexible tube and its end 841E1 is fitted around tube 841T2.

Coupled to tubular member 843T1 in the chamber 831 is an inflatable member 861 which normally is in a coiled position as shown in FIG. 34.

After the gun fires, the bolt return gas from the gun passes through the tube 841 and inflates members 861 to an inflated position as shown in FIG. 35 over the entrance 835E of the neck 835. This causes the member 861 to agitate and clear any jammed balls. The gas then exhausts out of the tube 841 back into the gun, thus allowing it to roll up into its deflated position. The inflation and deflation process only takes tenths of a second after each firing thereby allowing a constant agitation of the paintballs during a rapid fire situation. The pneumatic tongue agitator 861 makes no noise.

In one embodiment the inflatable member 861 may be formed of a suitable thin plastic which normally is in the deflated coiled position as shown in FIG. 34.

The end 845 of the tube also could be attached to the gun barrel 61 in communication with its interior downstream of the ball inlet 57 as shown in dotted form in FIG. 34. Attachment is by way of a fitting 851. In this embodiment a portion of the gas used in forcing the ball out of the barrel is fed to the member 861.

Thus the preferred embodiment of the pneumatic ball gun includes a sealed receiver; a forward locking bolt; in-line removable bolt assembly; dirt resistant trigger; gas regulation; pneumatic bolt return with the bolt duplicating pump gun action; gas assist in feeder tube; bolt return timing valve assembly; a removable plate for exposing the trigger mechanism and a pneumatic mechanism for preventing the balls from jamming in the ball holing chamber. Use of the gun for firing paint balls results in exceptionally low ball breakage. If ball breakage does occur, it occurs in the barrel of the gun and does not clog the operating mechanism.

I claim:

1. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening extending therethrough, said central opening of said bolt comprising a front opening portion and a rear opening portion with an annular seat located between said front and rear opening portions and facing rearward, in said rear position of said bolt, said front end of said bolt being located rearward of said inlet, a valve member located in said chamber for movement between rear and forward positions, said valve member having a rear end and a forward end with a valve opening extending into said valve member from said rear end to a forward position, said forward end of said valve member being located in said rear opening portion of said bolt with said valve opening being in fluid communication with said rear opening portion of said bolt, said valve member being movable relative to said bolt, said valve member having valve structure adapted to engage said seat of said bolt when said bolt and said valve members are in said rearward positions and form a seal with said seat, stop structure secured to the rear end of said valve member, a stop member located in said rear portion of said chamber for engaging said stop structure of said valve member for limiting forward movement of said valve member, a main channel for allowing pressurized gas to flow into said rear portion of said chamber, through said opening of said valve member and into said rear opening portion of said bolt, a sear for holding said bolt in its rear position, and a trigger mechanism for releasing said sear for allowing pressurized gas in said rear portion of said chamber to move said valve member forward for moving said bolt forward for allowing said valve structure and said seat to separate for allowing pressurized gas to flow through said forward opening of said bolt for forcing a ball in said bore out of said forward open end of said gun barrel.

2. The gun of claim 1, comprising:

a rear opening formed in said body leading to said rear end of said chamber, a valve support member located in said rear end of said chamber for supporting said valve member for movement in said chamber, said valve support member being removably secured in said rear end of said chamber for allowing said valve support member, said valve member, and said bolt to be removed from said chamber by way of said rear opening.

3. The gun of claim 1, comprising:

at least one slot formed in said body and extending outward from said front end of said chamber rearward of said ball inlet, a lock member aperture formed through said sidewall structure of said bolt and leading to said front opening portion, a lock member located in said lock member aperture for movement to inward and outward positions, said lock member being movable outward into said slot by the gas pressure in said front opening portion of said bolt stopping forward movement of said bolt, said lock member being movable to said inward position in said lock member aperture to allow said bolt to move in said chamber.

4. The gun of claim 3, wherein said trigger mechanism comprises:

a trigger member, means for pivotally coupling said trigger member to said body for movement to first and second positions, means for normally urging said trigger member to said first position of said trigger member, a trip member pivotally coupled to said trigger member for movement to first and second positions relative to said trigger member said trip member having an engaging end and an engaging surface, means for normally urging said trip member to said first position of said trip member, said sear having first and second ends, means for pivotally coupling said sear to said body for movement to first and second positions, means for normally urging said sear to said first position of said sear, said bolt having first and second spaced apart engaging surfaces facing forward, with said first surface being located rearward of said second surface, when said sear, trip member and said trigger member are located in said first positions respectively, said first end of said sear engages said first surface of said bolt to hold said bolt in said rearward position of said bolt, when said trigger member is moved to said second position of said trigger member, said engaging surface of said trip member pivots said sear to said second position of said sear to release said first end of said sear from said first surface of said bolt and allows said bolt to move to said forward position of said bolt, and bolt return means for moving said bolt to said rearward position of said bolt to allow said first end of said sear to engage said first surface of said bolt and hold said bolt in said rearward position of said bolt.

5. The gun of claim 4, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber by way of said slot, seal means for normally sealing said cock valve chamber from said connecting channel, when said trigger member is moved to said second position of said trigger member said trigger member and said bolt moves forward, said second surface of said bolt engages said trip member and moves said trip member to its second position for causing said trip member to engage said rear end of said rod of said cock valve and move said rod and hence said cock valve to said forward position of said cock valve for releasing gas from said cock valve chamber by way of said connecting channel and said slot into said front end of said elongated chamber for moving said bolt to said rear position in said elongated chamber to allow said trigger mechanism to move to said cocked position for holding said bolt in said rear position of said elongated chamber.

6. The gun of claim 5, wherein:

said seal means comprises an O-ring, said cock valve comprise an elongated cylindrical member which engages the inside of said O-ring and forms a seal with said O-ring, said elongated cylindrical member having a smaller diameter portion at said rear end of said cock valve which is moved within said O-ring when said cock valve is moved to said forward position by said rod to allow gas in said cock valve chamber to pass between said O-ring and said smaller diameter portion for releasing gas from said cock valve chamber into said front end of said elongated chamber by way of said connecting channel and said slot.

7. The gun of claim 3, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber by way of said slot, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel and said slot into said front end of said elongated chamber for moving said bolt to said rear position in said elongated chamber to allow said trigger mechanism to move to said cocked position for holding said bolt in said rear position of said elongated chamber.

8. The gun of claim 1, wherein said trigger mechanism comprises:

a trigger member, means for pivotally coupling said trigger member to said body for movement to first and second positions, means for normally urging said trigger member to said first position of said trigger member, a trip member pivotally coupled to said trigger member for movement to first and second positions relative to said trigger member said trip member having an engaging end and an engaging surface, means for normally urging said trip member to said first position of said trip member, said sear having first and second ends, means for pivotally coupling said sear to said body for movement to first and second positions, means for normally urging said sear to said first position of said sear, said bolt having an engaging surface facing forward, when said sear, trip member and said trigger member are located in said first positions respectively, said first end of said sear engages said engaging surface of said bolt to hold said bolt in said rearward position of said bolt, when said trigger member is moved to said second position of said trigger member, said engaging surface of said trip member pivots said sear to said second position of said sear to release said first end of said sear from said engaging surface of said bolt and allows said bolt to move to said forward position of said bolt, and bolt return means for moving said bolt to said rearward position of said bolt to allow said first end of said sear to engage said first surface of said bolt and hold said bolt in said rearward position of said bolt.

9. The gun of claim 1, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber.

10. The gun of claim 9, comprising:

a feed tube comprising wall structure having an inner end coupled to said ball inlet and an outlet end coupled to a ball chamber for holding and feeding balls sequentially into said bore.

11. The gun of claim 10, comprising:

a bolt seal supported by said front end of said bolt for movement with said bolt for forming a seal with said bore, a gas aperture extending outward from said bore through said body at a position such that bolt seal moves rearward of said gas aperture when said bolt is moved to said rearward position by gas released from said cock valve chamber, a gas inlet aperture formed through said wall structure of said feed tube and which extends in a direction to direct gas toward said outlet end of said feed tube, and a connecting passageway coupled between said gas outlet aperture of said body and said gas inlet aperture of said feed tube to allow gas flowing into said bore from said cock valve chamber to be applied into said feed tube to enhance movement of balls in feed tube into said bore when said bolt seal is moved rearward of said gas outlet aperture by gas from said cock valve chamber.

12. The gun of claim 11, comprising:

a fibrous member containing oil located in said bore rearward of said bolt in a position to be engaged by said rear end of said bolt when said bolt is moved to said rear position in said elongated chamber for mixing oil with gas in said bore for lubricating balls introduced into said bore by way of said ball inlet.

13. The gun of claim 9, comprising:

a gas pressure regulator supported by said body, said pressure regulator having a high pressure side and a low pressure side, said main channel and said second channel being coupled to said low pressure side, and an inlet coupled to said high pressure side for the application of gas under high pressure for flow into said low pressure side for applying lower pressure gas to said main channel and said second channel and for maintaining the gas applied to said main channel and said second channel to a generally constant pressure.

14. The gun of claim 1, comprising:

means for moving said bolt to said rear position in said elongated chamber for allowing said sear to hold said bolt in said rear position in said elongated chamber, and a fibrous member containing oil located in said bore rearward of said bolt in a position to be engaged by said rear end of said bolt when said bolt is moved to said rear position in said elongated chamber for mixing oil with gas in said bore for lubricating balls introduced into said bore.

15. The gun of claim 1, comprising:

a feed tube having an outlet end coupled to said ball inlet, a bolt seal supported by said front end of said bolt for movement with said bolt for forming a seal with said bore, a gas aperture extending outward from said bore through said body at a position such that bolt seal moves rearward of said gas aperture when said bolt is moved to said rearward position by gas released from said cock valve chamber, a gas inlet aperture formed through said wall structure of said feed tube and which extends in a direction to direct gas toward said outlet end of said feed tube, and a connecting passageway coupled between said gas outlet aperture of said body and said gas inlet aperture of said feed tube to allow gas flowing into said bore from said cock valve chamber to be applied into said feed tube to enhance movement of balls in feed tube into said bore when said bolt seal is moved rearward of said gas outlet aperture by gas from said cock valve chamber.

16. The gun of claim 15, comprising:

a fibrous member containing oil located in said bore rearward of said bolt in a position to be engaged by said rear end of said bolt when said bolt is moved to said rear position in said elongated chamber for mixing oil with gas in said bore for lubricating balls introduced into said bore.

17. The gun of claim 1, comprising:

a feed tube comprising wall structure having an inner end coupled to said ball inlet and an outlet end coupled to a ball chamber having an outlet for holding and feeding balls sequentially into said bore, a gas conduit having a first end coupled to said ball chamber and a second end for receiving gas from the gun, an inflatable member coupled to said first end of said gas conduit and located in said ball chamber near said outlet of said ball chamber for inflation by the gas for moving the balls to prevent the balls from becoming jammed.

18. The gun of claim 17, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber, a bolt seal supported by said front end of said bolt for movement with said bolt for forming a seal with said bore, a gas aperture extending outward from said bore through said body at a position such that bolt seal moves rearward of said gas aperture when said bolt is moved to said rearward position by gas released from said cock valve chamber, a gas inlet aperture formed through said wall structure of said feed tube and which extends in a direction to direct gas toward said outlet end of said feed tube, and a connecting passageway coupled between said gas outlet aperture of said body and said gas inlet aperture of said feed tube to allow gas flowing into said bore from said cock valve chamber to be applied into said feed tube to enhance movement of balls in feed tube into said bore when said bolt seal is moved rearward of said gas outlet aperture by gas from said cock valve chamber.

19. The gun of claim 18, comprising:

a fibrous member containing oil located in said bore rearward of said bolt in a position to be engaged by said rear end of said bolt when said bolt is moved to said rear position in said elongated chamber for mixing oil with gas in said bore for lubricating balls introduced into said bore.

20. The gun of claim 1, comprising:

a cavity formed in one side of said body in which are located said trigger member, said trip member, and said sear, and a plate removably secured to said one side of said body for covering said cavity when said plate is secured to said one side of said body and for exposing said cavity when said plate is removed from said one side of said body.

21. The gun of claim 1, comprising:

a gas pressure regulator supported by said body, said pressure regulator having a high pressure side and a low pressure side, said main channel being coupled to said low pressure side, and an inlet coupled to said high pressure side for the application of gas under high pressure for flow into said low pressure side for applying lower pressure gas to said main channel and for maintaining the gas applied to said main channel to a generally constant pressure.

22. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, said trigger mechanism comprising:

a trigger member, means for pivotally coupling said trigger member to said body for movement to first and second positions, means for normally urging said trigger member to said first position of said trigger member, a trip member pivotally coupled to said trigger member for movement to first and second positions relative to said trigger member said trip member having an engaging end and an engaging surface, means for normally urging said trip member to said first position of said trip member, said sear having first and second ends, means for pivotally coupling said sear to said body for movement to first and second positions, means for normally urging said sear to said first position of said sear, said bolt having an engaging surface facing forward, when said sear, trip member and said trigger member are located in said first positions respectively, said first end of said sear engages said engaging surface of said bolt to hold said bolt in said rearward position of said bolt, when said trigger member is moved to said second position of said trigger member, said engaging surface of said trip member pivots said sear to said second position of said sear to release said first end of said sear from said engaging surface of said bolt and allows said bolt to move to said forward position of said bolt, bolt return means for moving said bolt to said rearward position of said bolt to allow said first end of said sear to engage said first surface of said bolt and hold said bolt in said rearward position of said bolt, and a cavity formed in one side of said body in which are located said trigger member, said trip member, and said sear, and a plate removably secured to said one side of said body for covering said cavity when said plate is secured to said one side of said body and for exposing said cavity when said plate is removed from said one side of said body.

23. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, at least one slot formed in said body and extending outward from said front end of said chamber rearward of said ball inlet, a lock member aperture formed through said sidewall structure of said bolt and leading to said front opening portion, a lock member located in said lock member aperture for movement to inward and outward positions, said lock member being movable outward into said slot by the gas pressure in said central opening of said bolt stopping forward movement of said bolt, said lock member being movable to said inward position in said lock member aperture to allow said bolt to move in said chamber.

24. The gun of claim 23, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber.

25. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber.

26. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, a gas pressure regulator supported by said body, said pressure regulator having a high pressure side and a low pressure side, said flow path being coupled to said low pressure side, and an inlet coupled to said high pressure side for the application of gas under high pressure for flow into said low pressure side for applying lower pressure gas to said flow path and for maintaining the gas applied to said flow path to a generally constant pressure.

27. The gun of claim 26, comprising;

at least one slot formed in said body and extending outward from said front end of said chamber rearward of said ball inlet, a lock member aperture formed through said sidewall structure of said bolt and leading to said front opening portion, a lock member located in said lock member aperture for movement to inward and outward positions, said lock member being movable outward into said slot by the gas pressure in said front opening portion of said bolt stopping forward movement of said bolt, said lock member being movable to said inward position in said lock member aperture to allow said bolt to move in said chamber.

28. The paint ball gun of claim 27, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber.

29. The gun of claim 26, comprising:

a cock valve chamber having forward and rearward portions, a cock valve slidably located in said cock valve chamber for movement between said forward and rearward portions of said cock valve chamber, said cock valve having a rear end, a rod aperture in communication with said rearward portion of said cock valve chamber, a rod located in said rod aperture and having a rear end and a forward end adapted to engage said rear end of said cock valve, means for normally holding said cock valve in said rearward position of said cock valve, a second channel for allowing gas to flow into said cock valve chamber, a connecting channel extending from said rearward portion of said cock valve chamber to said front end of said elongated chamber, seal means for normally sealing said cock valve chamber from said connecting channel, said trigger mechanism being movable from a cocked position for holding said bolt in said rear position in said elongated chamber to a release position for engaging said rear end of said rod and moving said rod and hence said cock valve to said forward position of said cock valve for releasing gas from said cock valve chamber by way of said connecting channel into said front end of said elongated chamber for moving said bolt to said rear position in said elongated chamber to allow said trigger mechanism to move to said cocked position for holding said bolt in said rear position of said elongated chamber.

30. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, a feed tube comprising wall structure having an inner end coupled to said ball inlet and an outlet end coupled to a ball chamber having an outlet for holding and feeding balls sequentially into said bore, a gas conduit having a first end coupled to said ball chamber and a second end for receiving gas from the gun, an inflatable member coupled to said first end of said gas conduit and located in said ball chamber near said outlet of said ball chamber for inflation by the gas for moving the balls to prevent the balls from becoming jammed.

31. The gun of claim 30, comprising:

a bolt seal supported by said front end of said bolt for movement with said bolt for forming a seal with said bore, a gas aperture extending outward from said bore through said body at a position such that bolt seal moves rearward of said gas aperture when said bolt is moved to said rearward position by gas released from said cock valve chamber, a gas inlet aperture formed through said wall structure of said feed tube and which extends in a direction to direct gas toward said outlet end of said feed tube, and a connecting passageway coupled between said gas outlet aperture of said body and said gas inlet aperture of said feed tube to allow gas flowing into said bore from said cock valve chamber to be applied into said feed tube to enhance movement of balls in feed tube into said bore when said bolt seal is moved rearward of said gas outlet aperture by gas from said cock valve chamber.

32. The gun of claim 31, comprising:

a fibrous member containing oil located in said bore rearward of said bolt in a position to be engaged by said rear end of said bolt when said bolt is moved to said rear position in said elongated chamber for mixing oil with gas in said bore for lubricating balls introduced into said bore.

33. The gun of claim 31, comprising:

a block having a passage for forming said connecting passageway, said passage having an inlet and outlet, said block being connectable to said gun body such that said passage inlet and said passage outlet are in fluid communication with said gas aperture and said gas inlet aperture of said feed tube, a stop aperture formed through said body of said block in communication with said elongated chamber forward of said ball inlet, a movable stop coupled to said block for insertion through said stop aperture for location in said elongated chamber for holding a ball in said chamber until said gun is fired, means for moveably coupling said movable stop to said block in a manner to allow a ball when moved in said bore to engage and move said movable stop outward through said stop aperture to allow passage of said ball through said bore and out of said forward open end of said gun barrel.

34. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, a feed tube having an outlet end coupled to said ball inlet, a bolt seal supported by said front end of said bolt for movement with said bolt for forming a seal with said bore, a gas aperture extending outward from said bore through said body at a position such that bolt seal moves rearward of said gas aperture when said bolt is moved to said rearward position by gas released from said cock valve chamber, a gas inlet aperture formed through said wall structure of said feed tube and which extends in a direction to direct gas toward said outlet end of said feed tube, and a connecting passageway coupled between said gas outlet aperture of said body and said gas inlet aperture of said feed tube to allow gas flowing into said bore from said cock valve chamber to be applied into said feed tube to enhance movement of balls in feed tube into said bore when said bolt seal is moved rearward of said gas outlet aperture by gas from said cock valve chamber.

35. The gun of claim 34, comprising:

a fibrous member containing oil located in said bore rearward of said bolt in a position to be engaged by said rear end of said bolt when said bolt is moved to said rear position in said elongated chamber for mixing oil with gas in said bore for lubricating balls introduced into said bore.

36. A gun for firing balls with pressurized gas, comprising:

structure forming a passage for the passage of gas upon firing of said gun, a ball loading chamber for holding a plurality of balls, a feed conduit having an inlet coupled to said loading chamber for feeding balls serially to said gun, a gas conduit having a first end coupled to said loading chamber and a second end for receiving gas from said gun, an inflatable member coupled to said first end of said gas conduit and located in said loading chamber near said inlet of said feed conduit for inflation by the gas for moving the balls to prevent the balls from becoming jammed, said second end of said gas conduit being coupled to said passage of said gun for allowing gas to flow into said gas conduit for inflation of said inflatable member and then to flow back into said gun after the pressure therein decreases.

37. A gun for firing balls, comprising:

a body having an elongated chamber with a front end and a rear end, a gun barrel supported by said body and having an aperture extending from said front end of said chamber to a forward open end such that said chamber and aperture form a continuous bore, a ball inlet extending into said bore near said front end of said chamber for allowing a ball to enter said bore for movement in said bore forward of said inlet and out of said forward open end of said barrel, a bolt located in said chamber for movement between rear and forward positions, said bolt comprises side wall structure having a rear end and a front end with a central opening having a gas outlet at said front end of said bolt, a valve for closing said gas outlet of said bolt when said bolt is in said rear position in said chamber, a flow path for allowing pressurized gas to flow into said rear portion of said chamber and into said central opening of said bolt, a sear for holding said bolt in its rear position, a trigger mechanism for releasing said sear for allowing pressurized gas in said rear portion of said chamber to move said valve forward for moving said bolt forward for allowing said valve to open said gas outlet for allowing pressurized gas to flow through said gas outlet of said bolt for forcing a ball in said bore out of said forward open end of said gun barrel, a ball loading chamber for holding a plurality of balls, said loading chamber having an outlet coupled to said ball inlet for feeding balls serially to the gun, a gas conduit having a first end coupled to said loading chamber and a second end coupled to said bore for receiving gas from said bore following the release of said sear by said trigger mechanism, and an inflatable member coupled to said first end of said gas conduit and located in said loading chamber near said outlet of said loading chamber for inflation by the gas for moving the balls in said loading chamber to prevent the balls from becoming jammed.

38. A ball feeding apparatus for a gun for firing balls, comprising:

a ball loading chamber for holding a plurality of balls, a feed conduit having an inlet coupled to said loading chamber for feeding balls to the gun, a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said ball loading chamber comprises a lower wall and an upper wall, said first end of said gas conduit extends into said chamber to a position such that said inflatable member when inflated is located above and spaced from said lower wall.

39. The ball feeding apparatus of claim 38, wherein:

said ball loading chamber comprises a lower wall and an upper wall with opposite end walls, said inlet of said feed conduit is located between said end walls at a position such that said lower wall is located on opposite sides of said inlet between said inlet and said end walls and extends downward toward said inlet from said end walls with said chamber having space on opposite sides of said inlet between said inlet and said end walls for holding the balls, said gas conduit is coupled to said loading chamber between said inlet and one of said end walls, said inflatable member is positioned to extend toward said inlet when inflated.

40. The ball feeding apparatus of claim 39, wherein:

said inflatable member comprises an elongated member which when inflated has a given length and a dimension transverse to said length which is less than the maximum cross-sectional dimension of said inlet.

41. The ball feeding apparatus of claim 38, wherein:

said inflatable member comprises an elongated member which when inflated has a given length and a dimension transverse to said length which is less than the maximum cross-sectional dimension of said inlet.

42. The ball feeding apparatus of claim 41, wherein:

said inflatable member is normally in a coiled position when deflated.

43. A ball feeding apparatus for a gun for firing balls, comprising:

a ball loading chamber for holding a plurality of balls, a feed conduit having an inlet coupled to said loading chamber for feeding balls to the gun, a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said inflatable member comprises an elongated member which when inflated has a given length and a dimension transverse to said length which is less than the maximum cross-sectional dimension of said inlet.

44. The ball feeding apparatus of claim 43, wherein:

said inflatable member is normally in a coiled position when deflated.

45. A ball feeding apparatus for a gun for firing balls, comprising:

a ball loading chamber for holding a plurality of balls, a feed conduit having an inlet coupled to said loading chamber and an outlet adapted to be coupled to the gun for feeding balls serially to the gun, said feed conduit has a cross-sectional dimension sufficient to allow the balls to be fed only serially therethrough to the gun a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said ball loading chamber has a lower wall and an upper wall, said first end of said gas conduit extends into said chamber to a position such that said inflatable member when inflated is located above and spaced from said lower wall.

46. The ball feeding apparatus of claim 45, wherein:

said ball loading chamber comprises a lower wall and an upper wall with opposite end walls, said inlet of said feed conduit is located between said end walls at a position such that said lower wall is located on opposite sides of said inlet between said inlet and said end walls and extends downward toward said inlet from said end walls with said chamber having space on opposite sides of said inlet between said inlet and said end walls for holding the balls, said gas conduit is coupled to said loading chamber between said inlet and one of said end walls, said inflatable member is positioned to extend toward said inlet when inflated.

47. The ball feeding apparatus of claim 46, wherein:

said inflatable member comprises an elongated member which when inflated has a given length and a dimension transverse to said length which is less than the maximum cross-sectional dimension of said inlet.

48. The ball feeding apparatus of claim 45, wherein:

said inflatable member comprises an elongated member which when inflated has a given length and a dimension transverse to said length which is less than the maximum cross-sectional dimension of said inlet.

49. A ball feeding apparatus for a gun for firing balls, comprising:

a ball loading chamber for holding a plurality of balls, a feed conduit having an inlet coupled to said loading chamber and an outlet adapted to be coupled to the gun for feeding balls serially to the gun, said feed conduit has a cross-sectional dimension sufficient to allow the balls to be fed only serially therethrough to the gun, a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said ball loading chamber comprises a lower wall and an upper wall with opposite end walls, said inlet of said feed conduit is located between said end walls at a position such that said lower wall is located on opposite sides of said inlet between said inlet and said end walls and extends downward toward said inlet from said end walls with said chamber having space on opposite sides of said inlet between said inlet and said end walls for holding the balls, said gas conduit is coupled to said loading chamber between said inlet and one of said end walls, said inflatable member is positioned to extend toward said inlet when inflated.

50. A ball feeding apparatus for a gun for firing balls, comprising:

a ball loading chamber for holding a plurality of balls, a feed conduit having an inlet coupled to said loading chamber and an outlet adapted to be coupled to the gun for feeding balls serially to the gun, said feed conduit has a cross-sectional dimension sufficient to allow the balls to be fed only serially therethrough to the gun, a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said inflatable member comprises an elongated member which when inflated has a given length and a dimension transverse to said length which is less than the maximum cross-sectional dimension of said inlet.

51. The ball feeding apparatus of claim 50, wherein:

said inflatable member is normally in a coiled position when deflated.

52. A ball feeding apparatus for a gun for firing balls, comprising:

a ball loading chamber for holding a plurality of balls, a feed conduit having an inlet coupled to said loading chamber for feeding balls to the gun, a gas conduit having a first end coupled to said loading chamber and a second end for receiving gas from the gun, an inflatable member coupled to said first end of said gas conduit and located in said loading chamber near said inlet of said feed conduit for inflation by the gas for moving the balls to prevent the balls from becoming jammed, said ball loading chamber comprises a lower wall and an upper wall with opposite end walls, said inlet of said feed conduit is located between said end walls at a position such that said lower wall is located on opposite sides of said inlet between said inlet and said end walls and extends downward toward said inlet from said end walls with said chamber having space on opposite sides of said inlet between said inlet and said end walls for holding the balls, said gas conduit is coupled to said loading chamber between said inlet and one of said end walls, said inflatable member is positioned to extend toward said inlet when inflated, said inflatable member comprises an elongated member which when inflated has a given length and a dimension transverse to said length which is less than the maximum cross-sectional dimension of said inlet.

53. The ball feeding apparatus of claim 52, wherein:

said inflatable member is normally in a coiled position when deflated.

* * * * *